US012357058B2

(12) United States Patent
Rhoads et al.

(10) Patent No.: US 12,357,058 B2
(45) Date of Patent: Jul. 15, 2025

(54) INTERCHANGEABLE FOOTBED FOR FOOTWEAR AND A MODULAR SHOE SYSTEM HAVING AN INTERCHANGEABLE FOOTBED

(71) Applicant: CSR Developments, LLC, Encino, CA (US)

(72) Inventors: Jeffrey Christopher Rhoads, Encino, CA (US); Sarah Kenslow Rhoads, Encino, CA (US)

(73) Assignee: CSR Developments, LLC, Encino, CA (US)

( * ) Notice: Subject to any disclaimer, the term of this patent is extended or adjusted under 35 U.S.C. 154(b) by 0 days.

(21) Appl. No.: 18/531,437

(22) Filed: Dec. 6, 2023

(65) Prior Publication Data

US 2024/0180293 A1 Jun. 6, 2024

Related U.S. Application Data

(60) Provisional application No. 63/430,646, filed on Dec. 6, 2022.

(51) Int. Cl.

| | |
|---|---|
| ***A43B 3/24*** | (2006.01) |
| ***A43B 3/00*** | (2022.01) |
| ***A43B 13/36*** | (2006.01) |

(52) U.S. Cl.

CPC ..... *A43B 13/36* (2013.01); *A43B 3/0047* (2013.01); *A43B 3/24* (2013.01); *A43B 3/246* (2013.01)

(58) Field of Classification Search

CPC ..... A43B 13/36; A43B 3/0047; A43B 3/24; A43B 3/244; A43B 3/246

USPC ..... 36/15

See application file for complete search history.

(56) References Cited

U.S. PATENT DOCUMENTS

| | | | | | |
|---|---|---|---|---|---|
| 2,183,277 | A | * | 12/1939 | Heilhecker | A43B 13/36 36/15 |
| 3,019,534 | A | * | 2/1962 | Kauffman | A43B 3/246 D2/977 |
| 3,318,025 | A | * | 5/1967 | Barriga | A43B 13/36 36/36 B |
| 3,538,628 | A | * | 11/1970 | Einstein, Jr. | A43B 3/0078 36/15 |
| 3,890,725 | A | * | 6/1975 | Lea | A43B 3/244 36/11.5 |

(Continued)

FOREIGN PATENT DOCUMENTS

| | | | |
|---|---|---|---|
| CN | 202890698 U | * | 4/2013 |
| EP | 1804599 | | 8/2013 |

(Continued)

OTHER PUBLICATIONS

International Search Report and Written Opinion issued in PCT/US2023/082763, mailed Feb. 22, 2024.

*Primary Examiner* — Marie D Bays

(74) *Attorney, Agent, or Firm* — Arnall Golden Gregory LLP

(57) ABSTRACT

A footbed for a modular shoe system, a modular shoe system, and an interlocking fastener system for a footbed or for a modular shoe system, are provided. The interlocking fastener system includes a plurality of interlocking elements on a footbed configured to interlock with a plurality of complementary interlocking elements on a shoe base to releasably secure the footbed to the shoe base.

20 Claims, 20 Drawing Sheets

(56) References Cited

U.S. PATENT DOCUMENTS 4,317,294 A * 3/1982 Goodyear ..... A43B 13/36 36/36 B
4,420,894 A * 12/1983 Glassman ..... A43B 13/36 36/12
4,542,599 A * 9/1985 Annovi ..... A43B 5/0419 36/117.4
4,887,369 A * 12/1989 Bailey ..... A43B 3/24 36/15
4,936,028 A * 6/1990 Posacki ..... A43B 13/36 36/15
6,442,870 B1 * 9/2002 Tsai ..... A43B 3/103 36/15
6,701,643 B2 3/2004 Geer et al.
7,191,551 B2 3/2007 O'Connor et al.
7,284,344 B2 10/2007 Pawlus et al.
7,461,470 B2 12/2008 Dardinski et al.
9,107,472 B2 8/2015 Donzis et al.
2002/0174569 A1 * 11/2002 Tsai ..... A43B 3/103 36/11.5
2003/0200675 A1 10/2003 Gross
2003/0200676 A1 10/2003 Gross
2006/0021260 A1 * 2/2006 Kim ..... A43B 21/39 36/130
2008/0168681 A1 7/2008 Andersen et al.
2011/0119960 A1 5/2011 Celia
2012/0210606 A1 * 8/2012 Gheorghian ..... A43B 13/127 36/103
2013/0019504 A1 * 1/2013 Kim ..... A43B 3/246 36/103
2014/0259778 A1 9/2014 Anderson
2016/0324264 A1 * 11/2016 Johnson ..... A43B 3/244
2017/0303631 A1 10/2017 Johnson
2018/0235309 A1 8/2018 Mulholland
2021/0315319 A1 * 10/2021 Klein ..... A43B 13/122
2023/0320460 A1 * 10/2023 Jover Todoli ..... A43B 3/246 36/103
2024/0180293 A1 * 6/2024 Rhoads ..... A43B 3/0047

FOREIGN PATENT DOCUMENTS

ES 1261685 U * 3/2021 ..... A43B 13/36
TW I752448 1/2022
WO WO-2006/050092 5/2006
WO WO-2020/207605 10/2020

* cited by examiner

10

10

10

INTERCHANGEABLE FOOTBED FOR FOOTWEAR AND A MODULAR SHOE SYSTEM HAVING AN INTERCHANGEABLE FOOTBED

CROSS-REFERENCE TO RELATED APPLICATIONS

This application claims the benefit of U.S. Provisional Application 63/430,646 filed on Dec. 6, 2022, the disclosure of which is incorporated herein by reference.

FIELD OF THE INVENTION

The present disclosure is directed to an interchangeable footbed for footwear and footwear having an interchangeable footbed, and more particularly, to an interchangeable footbed for a modular shoe system, and a modular shoe system having an interchangeable footbed, and more particularly, to an interlocking fastener system suitable for an interchangeable footbed for footwear and for a modular shoe system.

BACKGROUND

Activities such as walking, hiking, running, water sports, going to work or lounging at home may be associated with specialized footwear that is geared primarily toward a single activity or condition and that provided specialized performance or preference features associated with a particular activity. For example, conventional walking shoes may have special cushions and support to promote a natural gait while walking, while hiking shoes may have stiffer support to secure a user's foot while on a trail. On the other hand, some conventional shoes may be configured specifically to provide warmth and comfort for lounging at home.

Furthermore, conventional insoles and shoe cushions are unsuitable for usage with footwear having open backs, such as slides, sandals, mules, clogs, etc. In these types of footwear, prior art insoles are insufficient because they fail to stay secured, provide adequate comfort, fit appropriately, or otherwise satisfy the objectives of the invention disclosed herein. Additionally, the present invention provides an improved insole that, by virtue of its configuration of being insertable and removable, allows for an insole that provides improved orthotic properties, such as providing improved support, comfort, stability, and longevity. Furthermore, the present invention provides an improved insole that, by virtue of its configuration of being insertable and removable using interlocking protuberances, allows for an insole that stays secured while also providing improved orthotic properties, such as improved support, comfort, stability, and longevity. Additionally, the present invention provides an improved insole that, by virtue of its configuration of being insertable, removable, and interchangeable, allows for an insole that is easily and selectively adaptable to any one of a plurality of different activities and/or conditions, as well as any one of a plurality of different aesthetic appearances. For example, the improved insole according to the present invention allows a user quickly and easily insert, replace, and/or interchange the insole to selectively adapt a single, modular shoe system to any one of a plurality of different activities and/or conditions, while at the same time providing suitable and desired performance features for the respective activities and/or conditions, thereby enabling a user to wear a preferred or favorite pair of shoes in a variety of different use cases. Additionally or alternatively, the improved insole according to the present invention allows a user to easily and selectively adapt a single, modular shoe system to any one of a plurality of different aesthetic appearances or to create their own custom and/or personalized aesthetic appearance, such as to easily and selectively choose and/or combine one or more materials, textures, colors, patterns, styles, etc. of one or more components of a modular shoe system to look and/or feel a certain way. Conventional insoles are insufficient for meeting the needs provided by the disclosure set forth herein.

SUMMARY OF THE INVENTION

The present disclosure recognizes that, with conventional footwear, if a user wishes to perform a variety of activities or to perform under a plurality of conditions, then the user must often possess multiple pairs of shoes, with each pair being geared primarily toward a single activity or condition, and switch between the different pairs of shoes to provide specialized performance features or preference features associated with each of the various activities and/or conditions that the user wishes to perform. As a result, a user may undesirably incur costs associated with purchasing multiple pairs of specialized shoes for various desired activities. Possessing various pairs of specialized shoes also may require the user to store multiple pairs of specialized shoes, which may undesirably consume storage space in the user's home. Furthermore, if a user wishes to perform a variety of different activities and/or perform activities under a variety of different conditions during the same outing away from home, such as a long day trip away from home or while travelling for vacation or business, a user may need to pack and transport multiple pairs of specialized shoes, which may be particularly difficult in instances in which space (e.g., luggage space, space in a backpack, space in a vehicle) is limited, and/or instances in which additional costs may be incurred (e.g., airport baggage check fees), and/or in instances in which the user may need to physically bear the burden of carrying or transporting the multiple pairs of specialized shoes during a variety of activities (e.g., while hiking, walking, commuting, etc. to another location to perform a different activity and/or under a different condition).

Furthermore, the present embodiments recognize that the need for multiple pairs of specialized shoes can require consumption of additional material resources and energy during the manufacturing process of the various pairs of specialized shoes, which may create additional waste during manufacturing and/or when the specialized shoes have outlived their functional lifespan. The present embodiments also recognize that pairs of specialized shoes that offer specialized performance or preference features geared toward a single activity or condition may make those shoes undesirable to other users that have little or no interest in those specialized activities, for example, even in instances in which the user likes the style, fit, or feel of the shoes.

The present embodiments recognize that, while conventional secondary or supplementary insoles may be passively placed inside a shoe to provide a user with additional support or comfort, such conventional secondary or supplementary insoles commonly are limited to a specialized function, such as providing arch support, and do not adapt or modify the specialized purpose of the shoe. Moreover, such conventional secondary or supplementary insoles are not suitable for open-back shoes, such as slides, mules, sandals, clogs, and other types of open-back shoes, where the conventional secondary or supplementary insoles cannot be placed or retained inside the shoe. The present invention allows for improved orthotic benefits for open-backed shoes, such as improved comfort, stability, durability, and longevity that was previously unachievable. For example, conventional insoles are unsuitable for use in open-backed shoes because they do not stay in place, can deform, and do not provide adequate support and comfort. The foregoing disclosure explains that the interlocking protuberances, among other features, of the insole and footbed provide the foregoing benefits.

As a result, the present embodiments recognize that there is a need for footwear that is capable of selectively adapting to a plurality of activities and/or conditions, rather than being simply geared toward, or limited to, a single activity or use condition.

These problems, and others, are addressed by the present embodiments, a first exemplary embodiment of which comprises a footbed for a modular shoe system having a shoe base and an upper portion on the shoe base, the footbed comprising a first surface configured to face the upper portion of the modular shoe system when inserted into the modular shoe system and to support a foot of a user, and a second surface configured to face the shoe base of the modular shoe system when inserted into the modular shoe system, wherein the second surface includes at least one first interlocking element configured to interlock with at least one second interlocking element on the modular shoe system. In an example, the second surface includes a plurality of first interlocking elements configured to interlock with a plurality of second interlocking elements on the modular shoe system.

Another exemplary embodiment of which comprises a modular shoe system comprising a shoe base having a midsole, and a footbed on the midsole of the shoe base, wherein the midsole includes at least one first interlocking element and the footbed includes at least one second interlocking element, and the first interlocking element and the second interlocking element are configured to interlock to releasably secure the footbed to the midsole of the shoe base. In an example, the midsole includes a plurality of first interlocking elements and the footbed includes a plurality of second interlocking elements, and the plurality of first interlocking elements and the plurality of second interlocking elements are configured to interlock to releasably secure the footbed to the midsole of the shoe base.

In this way, the present embodiments can provide an interchangeable modular footbed for footwear, and a modular shoe system including an interchangeable modular footbed, and more particularly a plurality of interchangeable modular footbeds, that can be quickly and easily inserted, replaced, and/or interchanged to selectively adapt a single, modular shoe system to any one of a plurality of different activities and/or conditions, while at the same time providing suitable and desired performance features for the respective activities and/or conditions, thereby enabling a user to wear a preferred or favorite pair of shoes in a variety of different use cases, for example to meet their activity and/or wellness needs.

The exemplary embodiments also may enable a user to save costs by only having to purchase a single pair of shoes for a variety of desired activities and/or conditions, while also saving storage space in the user's home by reducing a number of shoes that need to be purchased. Additionally, when a user is travelling away from home, the exemplary embodiments also may enable a user to save cost and reduce luggage space/weight, etc. by providing a single shoe system that is configured to be selectively adapted to a plurality of different activities and/or conditions. For example, if a user is traveling and only has space to bring along one pair of shoes, but the user needs shoes capable of being used in a multitude of different ways, the exemplary embodiments can enable a user to bring a single pair of modular shoes, such as a single selected stylish pair of modular shoes, along with one or more additional compact footbed inserts for modifying the single pair of shoes for use in a variety of different activities and/or conditions without sacrificing performance features of the shoe.

Furthermore, the modular shoes according to the exemplary embodiments may reduce or limit the consumption of material resources and consumption of energy during manufacturing and may also reduce or limit waste during the manufacturing process or when the modular shoes have outlived their functional lifespan. In an example, the present embodiments can allow for the selective adaptation of, or the changing out of, the internal support system (i.e., the footbed of the shoe) based on, for example, specific conditions (e.g., environmental conditions), activity, orthotic need, and/or user preference.

Additionally, the present embodiments can provide an interchangeable modular footbed for footwear, and a modular shoe system including an interchangeable modular footbed, and more particularly a plurality of interchangeable modular footbeds, that can be quickly and easily inserted, replaced, and/or interchanged to easily and selectively adapt to any one of a plurality of different aesthetic appearances or to create a custom and/or personalized aesthetic appearance, such as to easily and selectively choose and/or combine one or more materials, textures, colors, patterns, styles, etc. of one or more components of a modular shoe system to look and/or feel a certain way.

In an example, a modular shoe system can include an interlocking system that allows for an interchangeable footbed to be inserted or replaced into an interchangeable shoe base for use in a variety of use cases, such as comfort, support, wellness, aesthetics, specialized activity, and/or orthotic support. In a particular example, an interlocking midsole can be built into the sole of the shoe base thereby allowing a user to change out an interlocking footbed of the shoe base easily by selecting one of a plurality of footbeds having a matching interlocking mechanism allowing the footbeds to lock into the matching sole of the shoe easily, allowing the user to change out one footbed for another footbed based on a variety of different circumstances, uses, user preference, activity, comfort, orthotic, wellness, and/or aesthetic need, etc. For example, a modular shoe system can provide a variety of different footbed insert options with each available footbed insert, for example, catering to a specialized activity or activities such as hiking or walking, based on a variety of different orthotic needs, and/or based on a particular material (e.g., odor-absorbing material, sheepskin material for warmth, waterproof material, memory foam material that molds to a user's foot, etc.).

For example, and without limitation, a plurality of interchangeable footbed options can include one or more pairs of footbeds for use for specified activities such as running, hiking, walking, climbing, aerobic, cross-training, dance, fitness, athletics, etc. The plurality of interchangeable footbed options can include one or more orthotic footbed options, such as footbeds to provide arch support, support and/or relief for bunions, etc. The plurality of interchangeable footbed options can include one or more seasonal or weather-specific footbed inserts, such as footbeds that are waterproof, shearling-lined, sweat resistant, etc. The plurality of interchangeable footbed options can include one or more footbed inserts that aid in reducing or limiting formation of odor, smell, mold, fungus, etc., that provide support or relief at pressure points, etc., and/or that mold to a part of or all of a user's foot, such as memory foam inserts that mold to a heel or all of the user's foot.

In other examples, the plurality of interchangeable footbed options can include one or more footbed inserts that aid or assist with identifying and/or learning, such as one or more footbeds having markings, patterns, characters (e.g., character faces), letters, numbers, textures, imprints, or the like that assist a user, such as a child, a disadvantaged person, or another person, to identify right from left shoes, to identify different footbeds having different uses, etc.

The exemplary interlocking system of the modular shoe system can securely retain the footbed on the shoe base and prevent or restrict the footbed from separating from the shoe base and falling out of the shoe. For example, when a selected footbed is aligned with the shoe base, an interlocking system on one or both of the shoe base and the footbed can enable the footbed to be reliably retained in place during use, while at the same time enabling the footbed to be removed easily allowing for the user to switch out one footbed for another footbed with ease.

In an example, the footbed can include at least one interlocking element (e.g., a first interlocking element) and the shoe base, such as a midsole, can include at least one other interlocking element (e.g., a second interlocking element).

In an example, the footbed can include a plurality of first interlocking elements and the shoe base can include a plurality of second interlocking elements. The plurality of first interlocking elements and the plurality of second interlocking elements can be configured to interlock to releasably secure the footbed to the midsole of the shoe base. In a preferred example, the shoe base can include a pattern of congruent and repeated interlocking elements having oval cross-sections that extend from (e.g., are elevated from) a midsole of the shoe base. A bottom of a footbed can include a corresponding or matching pattern of congruent and repeated interlocking elements having oval cross-sections that extend from the bottom of the footbed and configured to mate, connect, or interlock with the interlocking elements of the midsole of the shoe base.

In an example, a cross-section of the interlocking elements of the footbed can be substantially complimentary to a cross-section of the interlocking elements of the midsole of the shoe base. In this way, when the interlocking elements of the footbed are interlocked with the interlocking elements of the midsole of the shoe base, the footbed and the midsole of the shoe base form a united structure. In a particular example, the footbed and the midsole of the shoe base form a united structure with minimal or no spacing between the interlocking elements of the footbed and the interlocking elements of the midsole of the shoe base (e.g., fitting together like connected puzzle pieces).

In an example, the interlocking elements can include a wave pattern. For example, a cross-section of each wave can include a nub or protuberance at a crest of the wave, and more particularly, an oval-shaped nub or protuberance. In an example, a cross-section of each trough can be complementary to the cross-section of the crest of the waves such that a cross-section of each trough mirrors the cross-section of the crest of each wave. In such an example, each trough of an interlocking element can be configured to receive and tightly secure a protuberance at a crest of the wave of another interlocking element.

In an example, one or more of a cross-sectional size, shape, pattern, spacing, etc. of the interlocking elements can be uniform along a length of the midsole of the shoe base and/or footbed. The wave patterns can have a length extending across a width of each of the footbed and the midsole of the shoe base (e.g., extending laterally across a width of each of the footbed and the midsole of the shoe base). The cross-section of the wave patterns on each of the footbed and the midsole of the shoe base can be uniform or constant along the length of the wave pattern (e.g., along the entire length of the waves and troughs).

In another example, one or more of a size, shape, pattern, spacing, etc. of the interlocking elements can differ along a length of the midsole of the shoe base and/or footbed. In some examples, the interlocking elements can be formed along a length of the midsole of the shoe base and/or footbed (e.g., along an entire length). In other examples, the interlocking elements can be formed only in particular areas of the midsole of the shoe base and/or footbed, such as one or more interlocking elements, or groups of interlocking elements, being formed at different locations along a length of the midsole of the shoe base and/or footbed with spacing in between. In an example, one or more interlocking elements, or groups of interlocking elements, can be separated from another interlocking element, or group of interlocking elements, by a non-interlocking element or region, such as complimentary sinusoidal or square cross-sectional features, or a region that forms an air gap or a resilient feature, for example, to provide support, shock absorption, etc.

In an example, the interlocking elements can be configured such that the footbed is capable of being attached to or aligned with the shoe base in only a single way, such as a single position, arrangement, etc. For example, the interlocking elements can be configured such that a footbed for a right shoe can only be coupled to a shoe base of a right shoe and a footbed for a left shoe can only be coupled to a shoe base of a left shoe.

The interlocking elements, such as nub/wave features, connecting the footbeds to the midsole of the shoe base locking elements can be configured to allow the footbed to be removed and/or replaced (e.g., repeatedly removed and/or replaced) within the midsole of the shoe bed.

The exemplary embodiments can provide a support surface for a user's foot that is uniform, consistent, continuous, and/or flat, as well as a uniform aesthetic appearance, once the footbed is secured in place on the shoe base. The exemplary embodiments can provide a reliable securement system between the footbed and the base of the shoe such that the footbed will remain securely in place during any activity. When a user is done using a particular footbed and wants to switch out the footbed, for example, for another different footbed, the user can simply and easily pull the footbed to release the interlocking elements such that the footbed will detach from the base of the shoe allowing for the user to switch to a different desired footbed to easily be inserted in place of the removed footbed. In an example, the footbed can include one or more tabs (e.g., one or more small tabs, finger tabs, etc.), such as a tab located on or just behind the heel of the footbed. By pulling the tab located just behind the heel of the footbed, the footbed can be detached from the base of the shoe allowing for the user to remove the present footbed and switch to a different desired footbed.

In an example, each pair of footbeds can be configured to lock together to provide ease of storage and organization when the pair of footbeds are not in use in the shoe system. For example, the interlocking elements of the left and right footbeds can be configured to lock together to secure the footbeds to each other, thereby enabling the corresponding footbeds to be securely stored together and transported as a pair of footbeds in an organized way and minimizing a risk of loss of one of the footbeds of the pair, or mixing up of different types of available footbeds, etc. when the pair of footbeds are not in use in the shoe system.

The features of the exemplary embodiments may be particularly advantageous for users that seek to wear open-back shoes, such as slides, mules, sandals, clogs, and other types of open-back shoes, for which a conventional secondary or supplementary insole cannot be placed or retained inside the shoe to provide the user with additional support and/or comfort. For example, a user with a high arch may not be able to use conventional sandals or slides/mules or other open-backed footwear because such conventional footwear may not properly support the user's instep. In another example, someone with a flat foot may not be able to comfortably wear an open-backed shoe with a normal arch without discomfort. Moreover, there is no current solution to be able to lock an insole in place without it falling out of an open-backed shoe.

The examples of the present embodiments can allow for the adaptation or the changing out of the internal support system, for example, from an open-backed shoe to provide the orthotic need of the user, such as a footbed that matches the unique foot profile of the user without limitation, thereby enabling the user to wear an open-back pair of shoes, such as slides, mules, sandals, clogs, etc., that the user otherwise could not wear or would be uncomfortable for the user to wear. Moreover, the examples of the present embodiments can enable the placement of an insole into open-back footwear without a risk of the insole falling out of the open-back footwear, which the prior art has failed to address.

In other examples, the present embodiments can be configured for not only open-back footwear, but also for closed systems (i.e., closed-back footwear). For example, a modular shoe system according to an exemplary embodiment can be configured to utilize interlocking elements to secure one or more available footbeds to a midsole of the shoe base. To provide or improve access for inserting, removing/replacing, or securing a footbed to the midsole of the shoe base, an example modular shoe can include, for example, a zipper, side flap, and/or a wide opening at the top of the shoe, or the like. This may be particularly advantageous for shoes having enclosed upper portions such as dress shoes, high-top shoes, boots, shoes without laces, among others.

For purposes of this disclosure, a shoe or shoe system can include an open-back shoe, such as slides, mules, sandals, clogs, slippers, or the like, or a closed-back shoe, such as a low-top shoe, high-top shoe, sneaker, dress shoe, boot, or the like. The shoe or shoe system can include causal, dress, athletic, orthotic, cross-training, outdoor, waterproof, or other shoes. The shoe or shoe system can include shoes for women, men, kids, toddlers, etc.

Based on the materials used in the construction of the attachment elements, and the interaction of the attachment elements with each other, the exemplary attachment system also can provide additional bounce/resiliency, shock-absorbing, comfort, or support features, for example, for a user's gait or when walking/standing for long periods of time. As a result, the modular shoe system, and particularly, the interlocking elements of the modular shoe system, can provide an additional level of support, orthotics, etc. (e.g., similar to springs in a mattress), in addition to providing a secure and reliable attachment system for retaining and securing a footbed to the shoe base of the modular shoe system.

The interlocking elements can be formed using various suitable material types, such as thermo-plastics (e.g., PVC), two-component polyurethanes (e.g., PU), co-polymers, rubbers, ethyl-vinyl acetates (e.g., EVA), and/or bio-derived or bio-inspired materials that are environmentally friendly, and equivalents thereof.

Other features and advantages of the present embodiments will become apparent to those skilled in the art upon review of the following detailed description and drawings.

BRIEF DESCRIPTION OF THE DRAWINGS

These and other aspects and features of embodiments of the present embodiments will be better understood after a reading of the following detailed description, together with the attached drawings, wherein.

DETAILED DESCRIPTION

Figure 1:
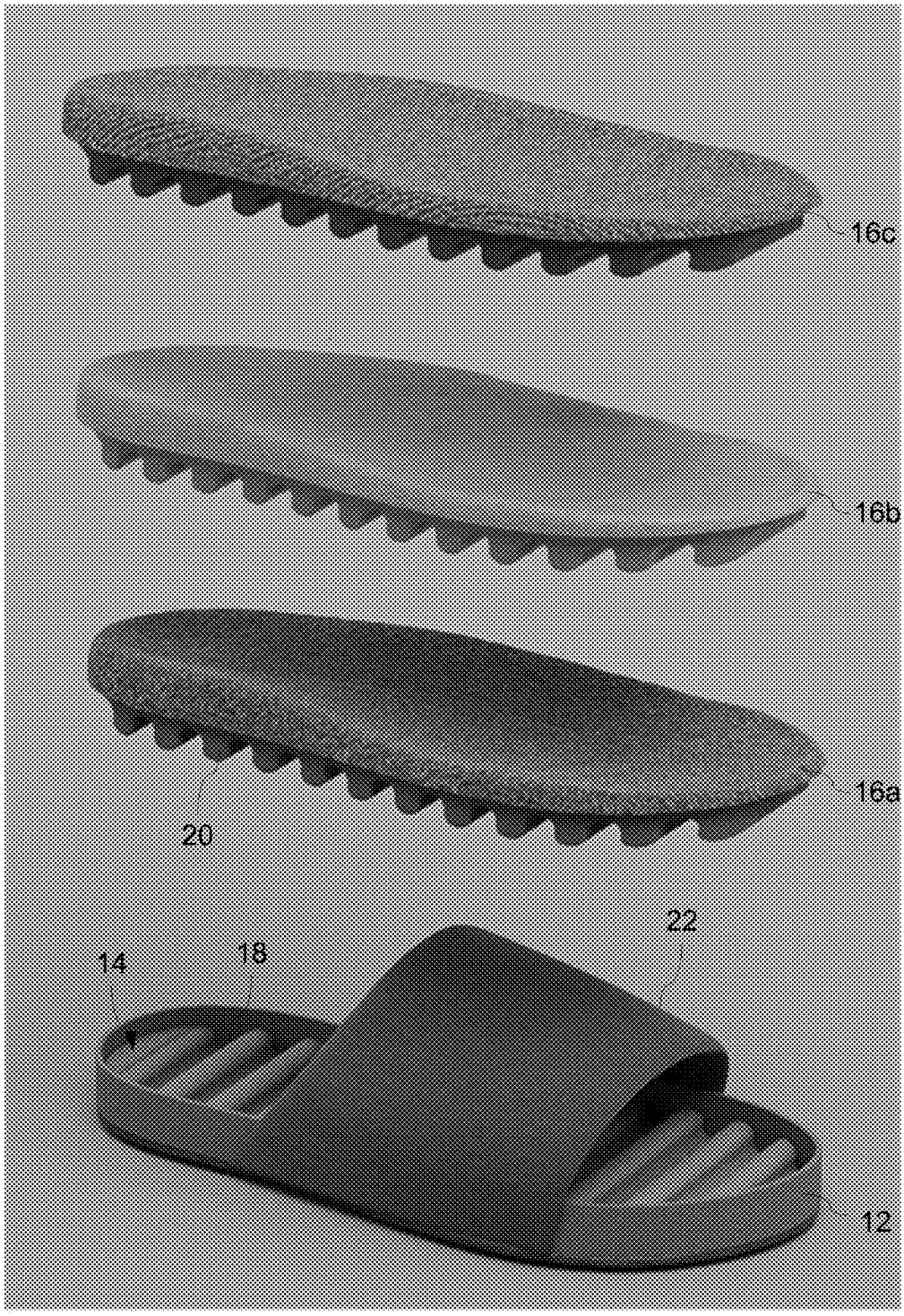
FIG. 1 is an exploded view of a modular shoe system, according to one or more embodiments of the present disclosure.

The present embodiments are now described more fully hereinafter with reference to the accompanying drawings, in which embodiments of the disclosure are shown. These embodiments may, however, be embodied in many different forms and should not be construed as limited to the embodiments set forth herein; rather, these embodiments are provided so that this disclosure will be thorough and complete, and will fully convey the scope of the invention to those skilled in the art.

Referring now to the drawings, FIGS. 1-18 illustrate exemplary embodiments of a footbed for a modular shoe system, a modular shoe system, and an interlocking fastener system suitable for a footbed or for a modular shoe system.

With reference to FIG. 1, an exemplary modular shoe system 10 can include a shoe base 12 having a surface (e.g., an upper surface such as a midsole 14) and one or more footbeds 16 configured to be releasably secured to the shoe base 12. The modular shoe system 10 is not limited to the illustrated example and can include various types of upper and/or lower configurations, such as open-backed shoes, closed-backed shoes, open-toed shoes, thong sandals, slides, mules, boots, sneakers, dress shoes, etc.

As shown in FIG. 1, an exemplary modular shoe system 10 can include a plurality of interchangeable footbed options, which are represented by 16*a*-16*c*. The plurality of interchangeable footbed options can include one or more pairs of footbeds 16*a*-16*c* for use for specified activities such as running, hiking, walking, climbing, aerobic, cross-training, dance, fitness, athletics, etc. The plurality of interchangeable footbed options 16*a*-16*c* can include one or more orthotic footbed options, such as footbeds to provide arch support, support and/or relief for bunions, etc. The plurality of interchangeable footbed options 16*a*-16*c* can include one or more seasonal or weather-specific footbed inserts, such as footbeds that are waterproof, shearling-lined, sweat resistant, etc. The plurality of interchangeable footbed options 16*a*-16*c* can include one or more footbed inserts that aid in reducing or limiting formation of odor, smell, mold, fungus, etc., that provide support or relief at pressure points, etc., and/or that mold to a part of or all of a user's foot, such as memory foam inserts that mold to a heel or all of the user's foot. Other interchangeable footbed options are possible and would be readily envisaged by those skilled in the art.

Figure 2:
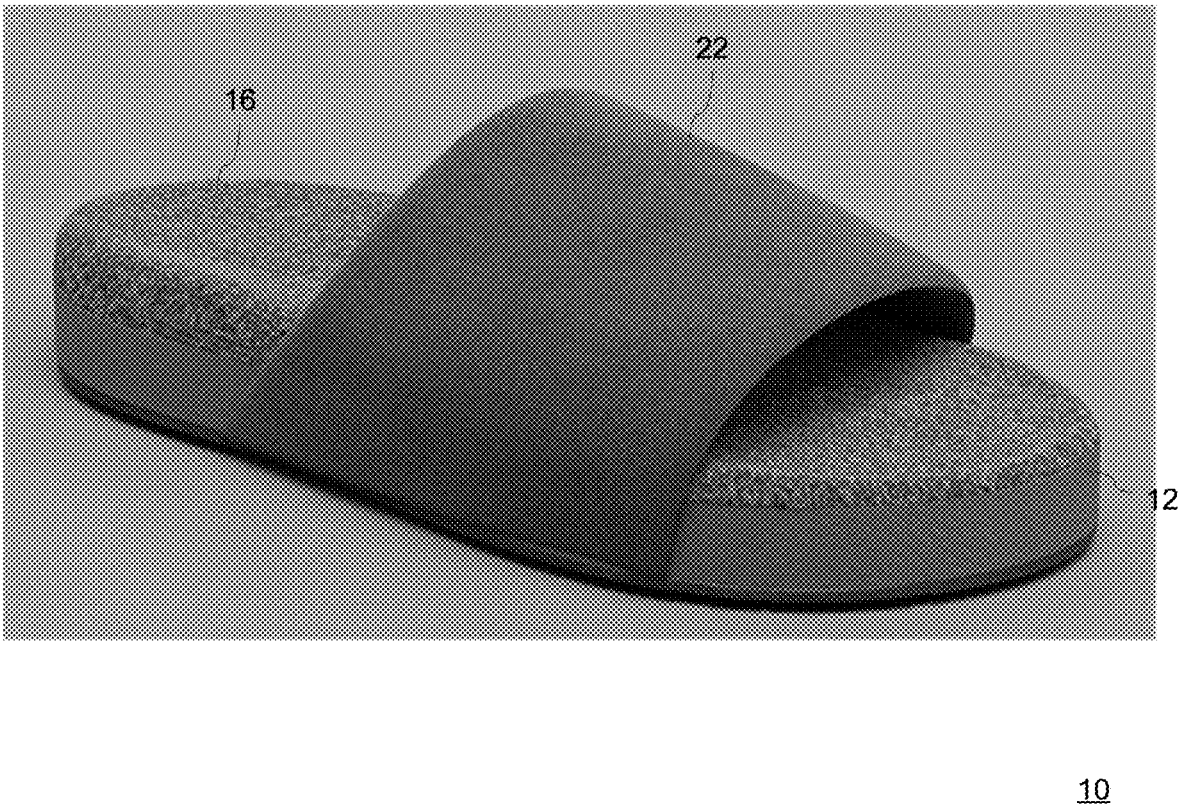
FIG. 2 is an assembled view of the modular shoe system of FIG. 1.

As shown in FIG. 1, in an example, the midsole 14 can include a plurality of first interlocking elements 18 and the footbed 16 can include a plurality of second interlocking elements 20. In this example, the plurality of first interlocking elements 18 and the plurality of second interlocking elements 20 are configured to interlock to releasably secure the footbed 16 to the midsole 14 of the shoe base 12, as shown in FIG. 2. Each of the plurality of first interlocking elements 18 and the plurality of second interlocking elements 20 can be formed from a resilient material. For example, the interlocking elements can be formed using various suitable resilient materials, such as thermo-plastics (e.g., PVC), two-component polyurethanes (e.g., PU), co-polymers, rubbers, ethyl-vinyl acetates (e.g., EVA), and/or bio-derived or bio-inspired materials that are environmentally friendly, and equivalents thereof.

Figure 3:
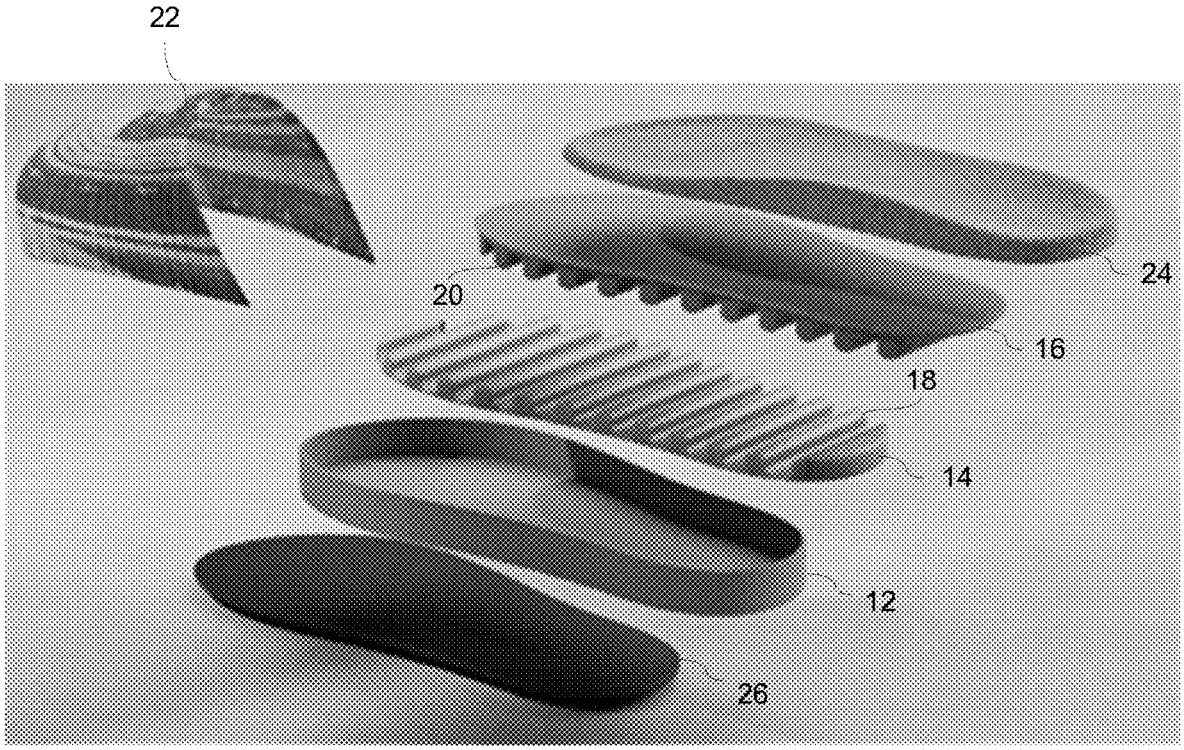
FIG. 3 is an exploded view of a modular shoe system, according to one or more embodiments of the present disclosure.

As shown in FIG. 3, an exemplary modular shoe system 10 can include a midsole 14 having a plurality of first interlocking elements 18 and a footbed 16 having a plurality of second interlocking elements 20. The plurality of first interlocking elements 18 and the plurality of second interlocking elements 20 are configured to interlock to releasably secure the footbed 16 to the midsole 14 of the shoe base 12. In the example, the modular shoe system 10 includes an upper 22 coupled (e.g., glued, cemented, stitched, fused, etc.) to the shoe base 12. In another example, the upper 22 can be integrally formed with the shoe base 12. In an example, the upper 22 can include padding, foam (e.g., memory foam), or the like on an underside facing a user's foot. In an example, the upper 22 can include one or more devices on an upper side configured to tighten the upper against a user's foot, such as one or more canvas belts, laces, hook and loop fasteners, or the like configured to be tightened and/or adjusted in length and/or position. The midsole 14 can be permanently coupled (e.g., glued) and installed into the shoe base 12. In the example, a sole 26 can be permanently coupled (e.g., glued) and installed onto a lower side of the shoe base 12. In another example, the shoe base 12 can be integrally formed with a sole 26. In the example, a foot support 24 can be permanently coupled (e.g., glued) and installed onto an upper side of the footbed 16. In another example, the foot support 24 can be integrally formed with the footbed 16.

Figure 4:
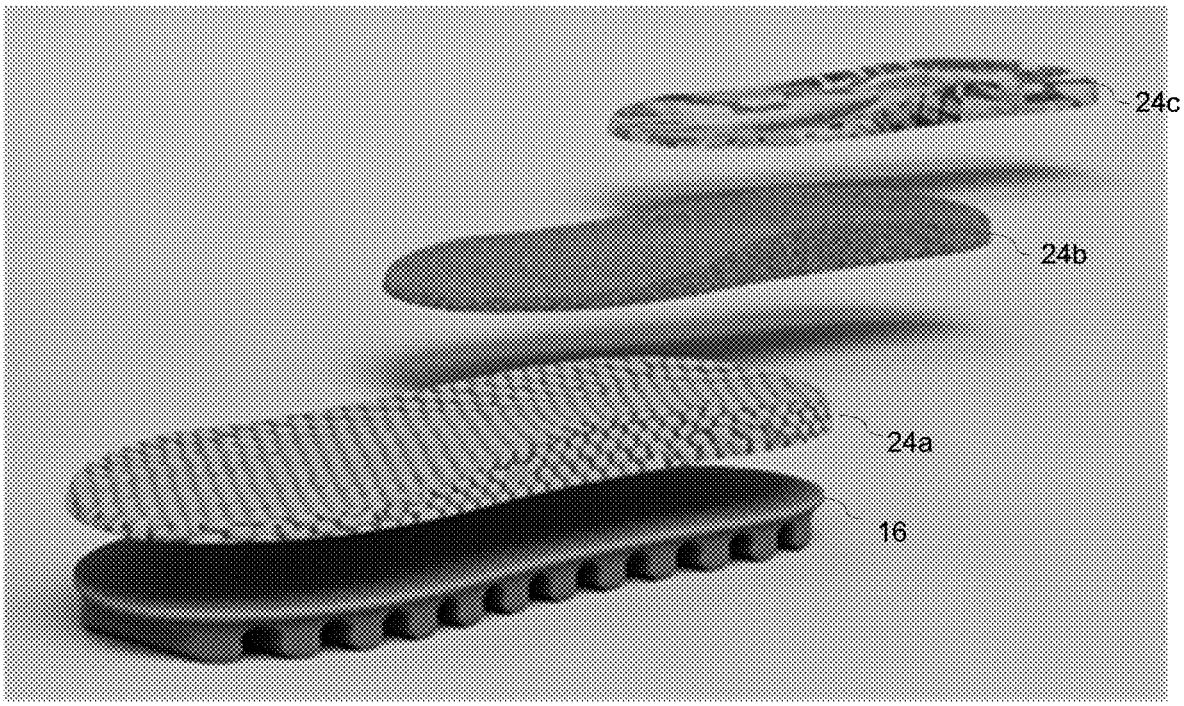
FIG. 4 is a partial exploded view of a modular shoe system, according to one or more embodiments of the present disclosure.

As shown in FIG. 4, the exemplary modular shoe system 10 can include a plurality of interchangeable foot support options, which are represented by 24*a*-24*c*, which can be permanently coupled (e.g., glued) and installed onto an upper side of the footbed 16. The plurality of foot support options 24*a*-24*c* can be provided for use for specified activities such as running, hiking, walking, climbing, aerobic, cross-training, dance, fitness, athletics, etc. The plurality of foot support options 24*a*-24*c* can include one or more orthotic footbed options, such as foot supports to provide arch support, support and/or relief for bunions, etc. The plurality of foot support options 24*a*-24*c* can include one or more seasonal or weather-specific footbed inserts, such as foot supports that are waterproof, shearling-lined, sweat resistant, etc. The plurality of foot support options 24*a*-24*c* can include one or more components that aid in reducing or limiting formation of odor, smell, mold, fungus, etc., that provide support or relief at pressure points, etc., and/or that mold to a part of or all of a user's foot, such as memory foam inserts that mold to a heel or all of the user's foot. Additionally, the plurality of foot support options 24*a*-24*c* can be configured for one or more different aesthetic appearances or sensory characteristics, such as one or more materials, textures, colors, patterns, styles, etc. to enable a user to create their own custom and/or personalized look and/or feel. Other foot support options 24*a*-24*c* are possible and would be readily envisaged by those skilled in the art.

Figure 5:
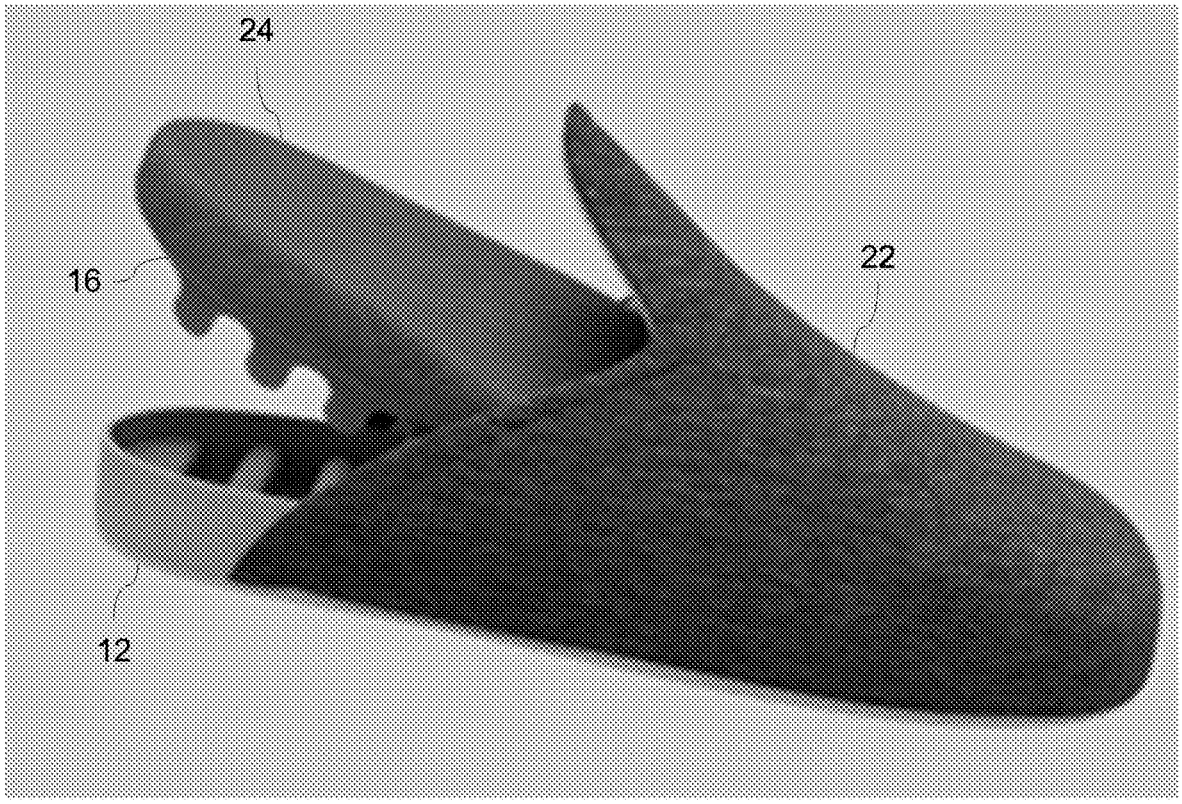
FIG. 5 is a perspective view of a partially assembled modular shoe system, according to one or more embodiments of the present disclosure.
Figure 6A:
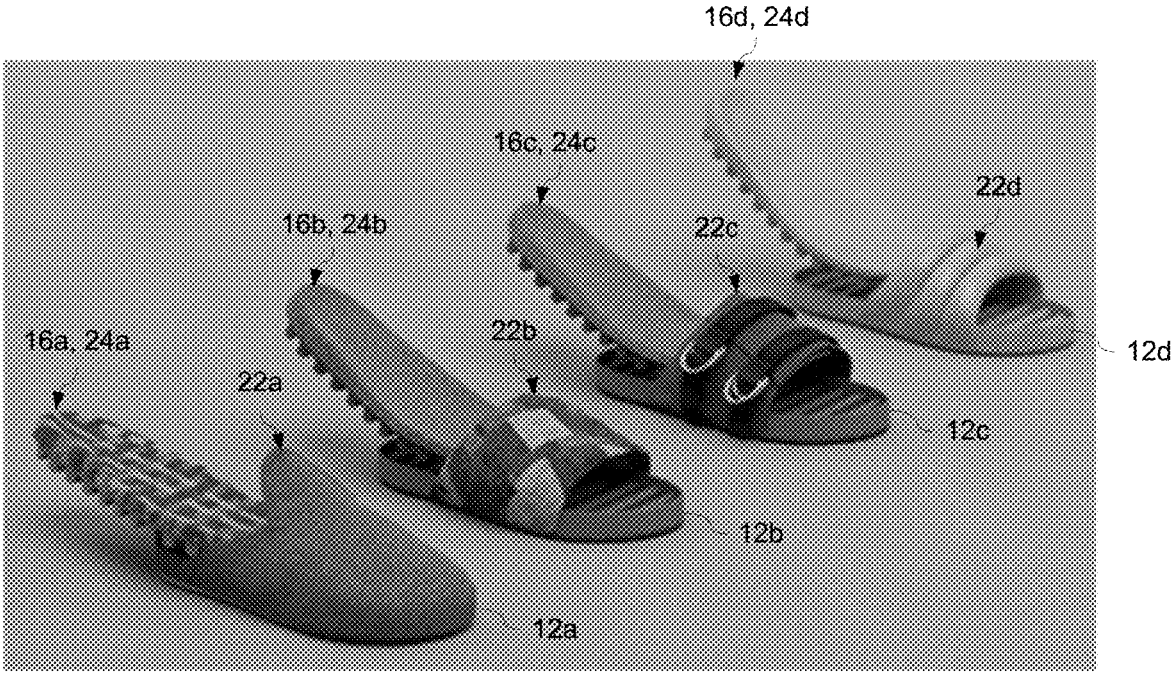
FIGS. 6A-6H are perspective views illustrating a plurality of interchangeable shoe bases and interchangeable footbeds of a modular shoe system, according to one or more embodiments of the present disclosure.
Figure 6B:
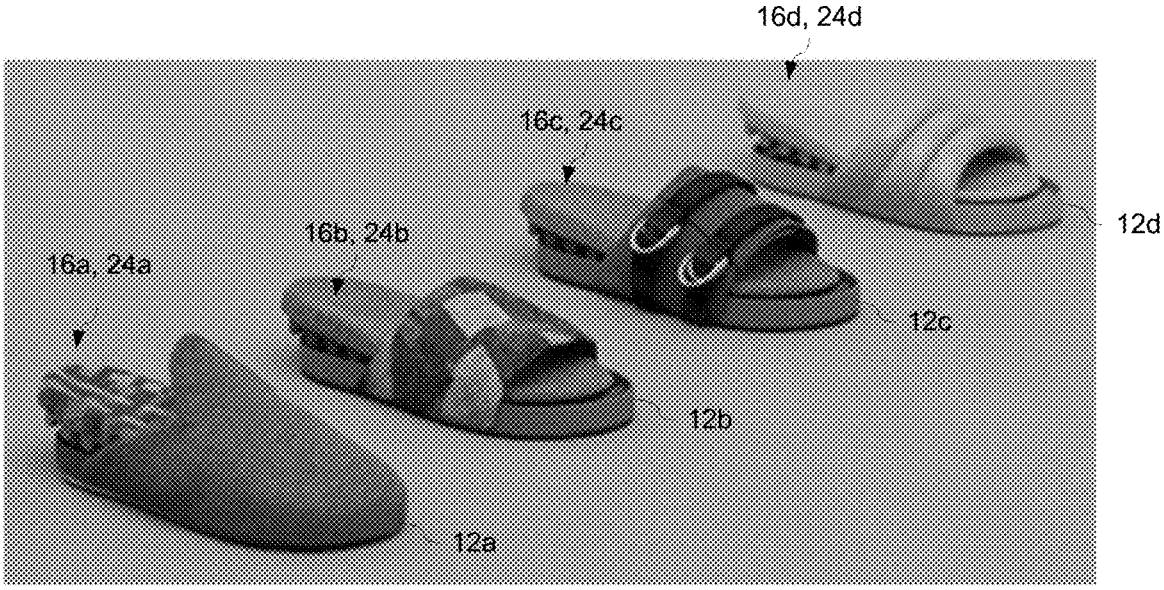
Figure 6C:
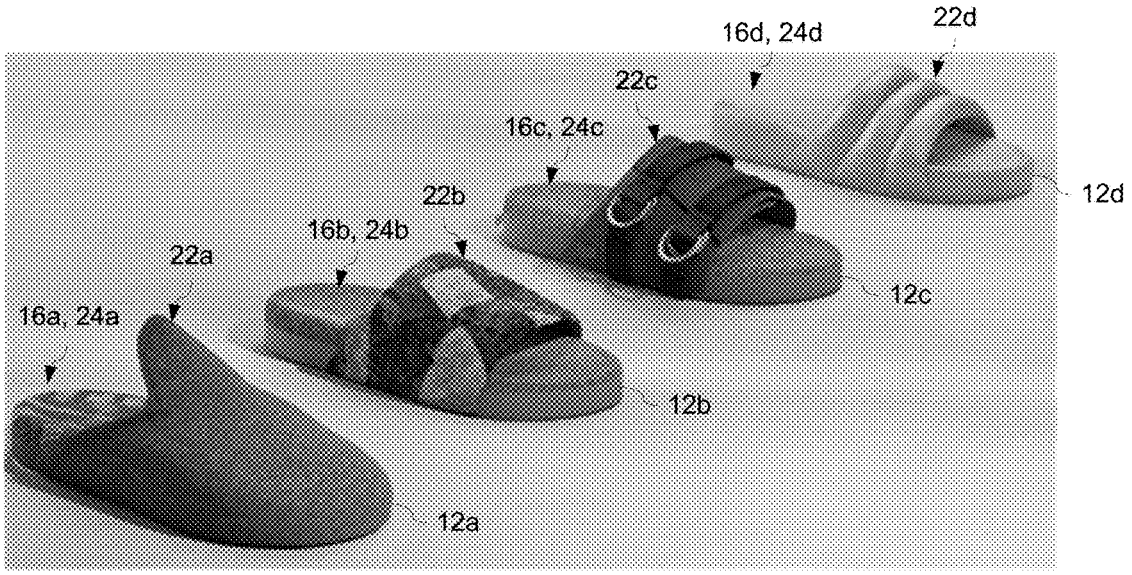
Figure 6D:
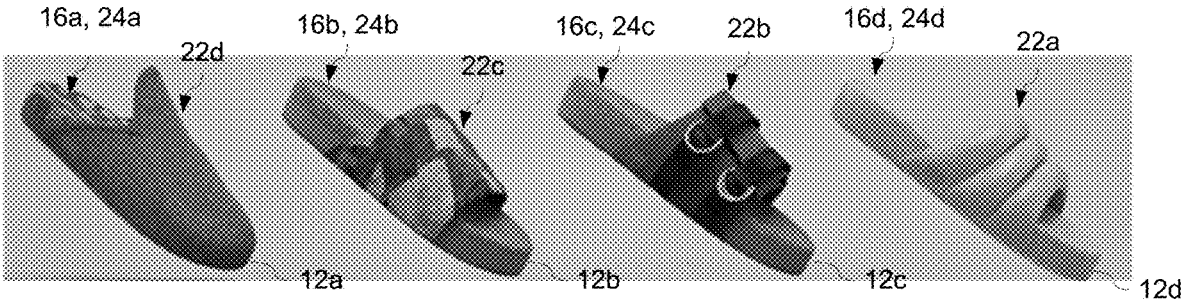
Figure 6E:
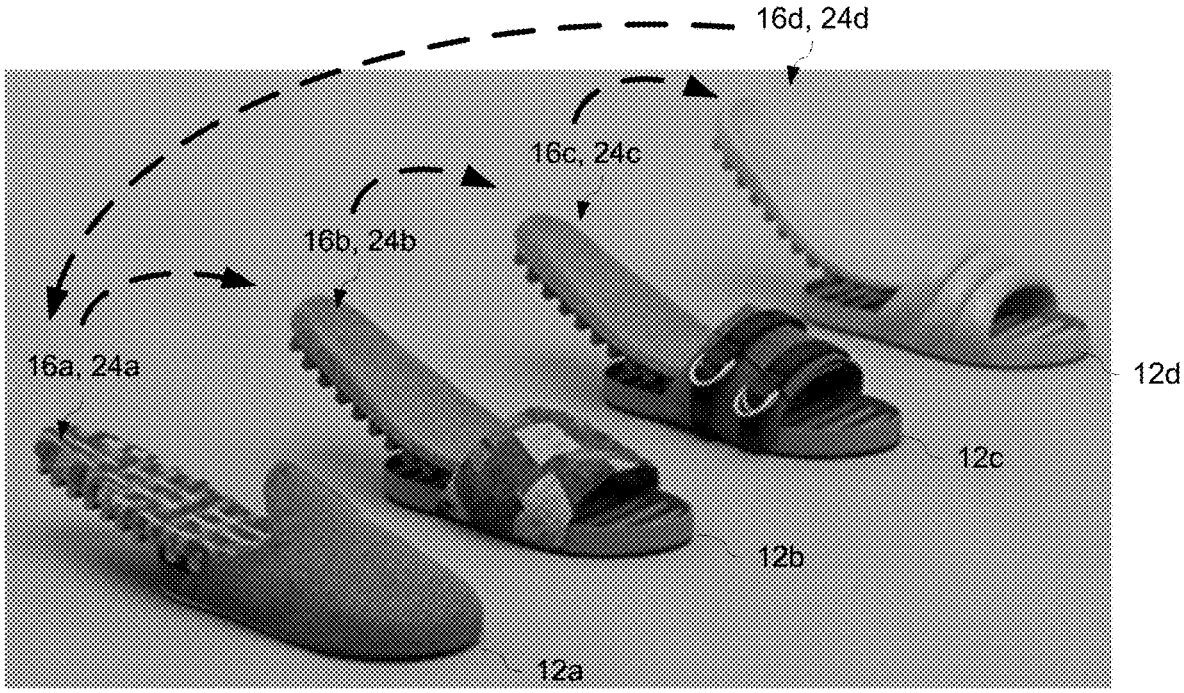
Figure 6F:
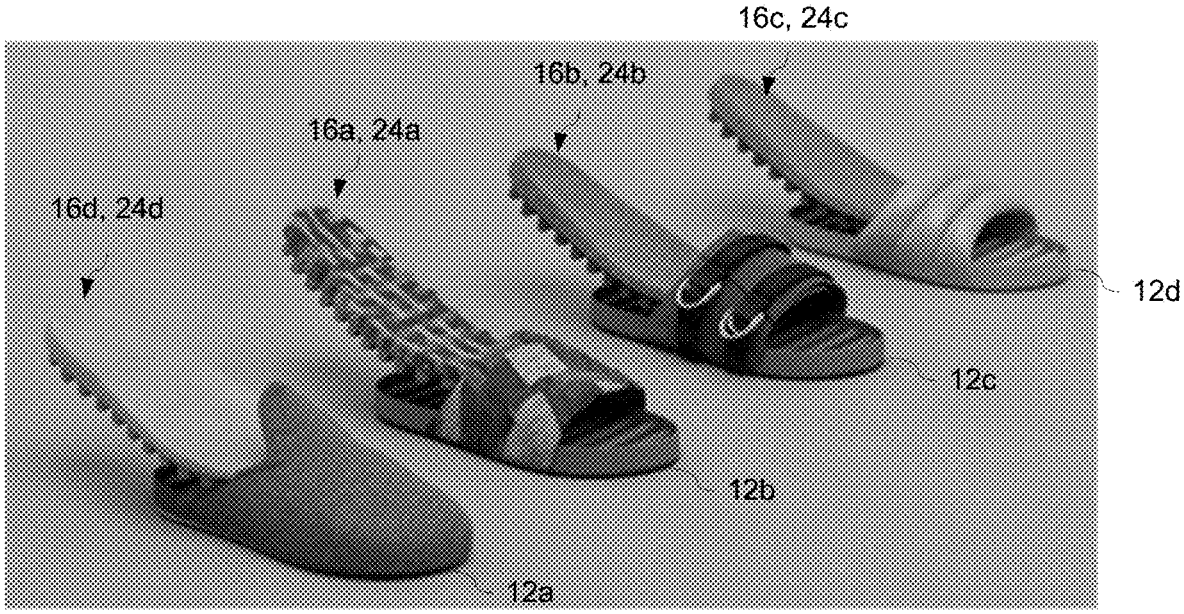
Figure 6G:
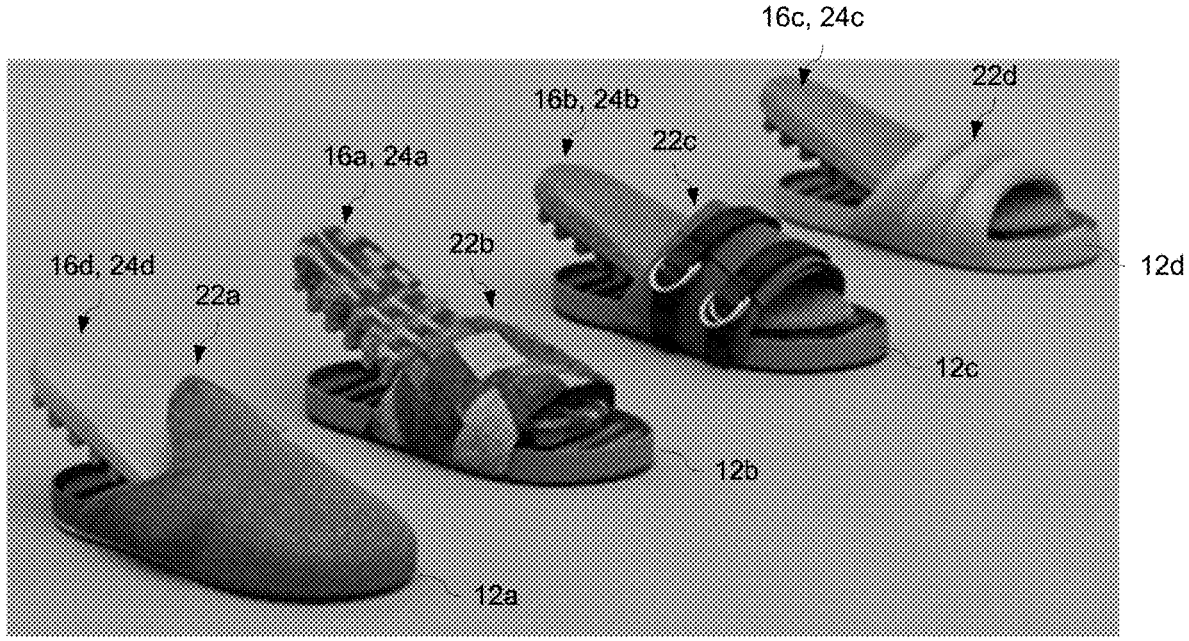
Figure 6H:
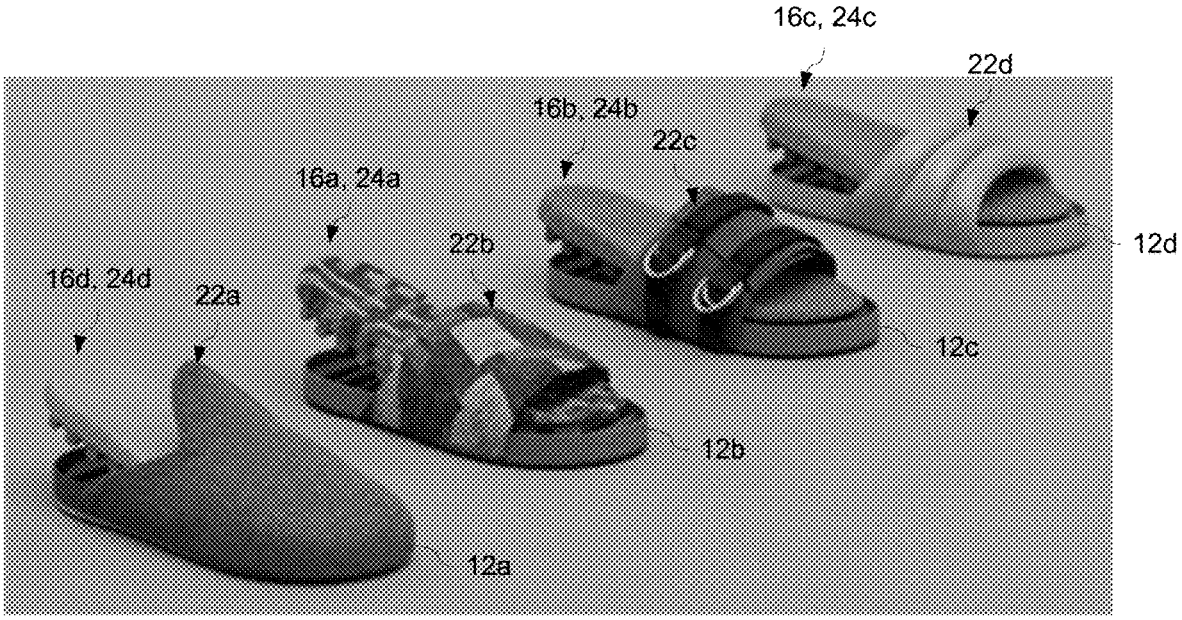

As shown in FIG. 5, in an exemplary modular shoe system 10, a footbed 16 having foot support 24 is inserted into a shoe base 12 having an upper 22 with the foot support 24 facing the upper 22 when inserted into the shoe base 12. The interlocking elements 20 of the footbed 16 interlock with the interlocking elements 18 of the midsole 14 of the shoe base 12 to releasably secure the footbed 16 to the midsole 14 of the shoe base 12.

As shown in FIGS. 6A-6H, an exemplary modular shoe system 10 includes a plurality of interchangeable footbed options, which are represented by 16*a*, 24*a*-16*d*, 24*d*, and a plurality of interchangeable shoe base options, which are represented by 12*a*-12*d*. The shoe base options 12*a*-12*d* can include a plurality of upper options 22*a*-22*c*, as shown in the illustrated example. Other interchangeable footbed options 16*a*, 24*a*-16*d*, 24*d*, shoe base options 12*a*-12*d*, and upper options 22*a*-22*c* are possible and would be readily envisaged by those skilled in the art.

As shown again in shown in FIGS. 6A-6H, the exemplary modular shoe system 10 can include a plurality of interchangeable upper options, which are represented by 22*a*-22*c*, which can be permanently coupled (e.g., glued) and installed onto an upper side of the shoe base 12. The plurality of upper options 22*a*-22*c* can be provided for use for specified activities such as running, hiking, walking, climbing, aerobic, cross-training, dance, fitness, athletics, etc. The plurality of upper options 22*a*-22*c* can be configured for seasonal or weather-specific use, such as being waterproof, shearling-lined, sweat resistant, etc. The plurality of upper options 22*a*-22*c* can include one or more components that aid in reducing or limiting formation of odor, smell, mold, fungus, etc., that provide support or relief, etc., and/or that mold to a part of or all of a user's foot, such as memory foam that molds to a top and/or sides of the user's foot. Additionally, the plurality of upper options 22*a*-22*c* can be configured for one or more activity, performance, and/or wellness needs, such as one or more activity, conditions, and/or performance features, etc. to meet the use needs of a user, and/or one or more different aesthetic appearances or sensory characteristics, such as one or more materials, textures, colors, patterns, styles, etc. to enable a user to create their own custom and/or personalized look and/or feel. Other upper options 22*a*-22*c* are possible and would be readily envisaged by those skilled in the art.

As shown in FIGS. 6A-6D, each of the interchangeable footbed options 16*a*, 24*a*-16*d*, 24*d* can be inserted into a shoe base option 12*a*-12*d* with the foot support 24*a*-24*d* facing the upper option 22*a*-22*c*. The interlocking elements 20 of each footbed option 16*a*-16*d* interlock with the interlocking elements 18 of each shoe base option 12*a*-12*d* to releasably secure each footbed option 16*a*-16*d* to each shoe base option 12*a*-12*d*.

As shown in FIGS. 6E-6H, any one of the interchangeable footbed options 16*a*, 24*a*-16*d*, 24*d* can be releasably interchanged with any one of the shoe base options 12*a*-12*d*. For example, as schematically illustrated by dashed-arrows in FIG. 6E, any of the interchangeable footbed options 16*a*, 24*a*-16*d*, 24*d* can be removed from a shoe base option 12*a*-12*d* and inserted into a different shoe base option 12*a*-12*d* with the foot support 24*a*-24*d* facing the upper 22. The interlocking elements 20 of each footbed option 16*a*-16*d* interlock with the interlocking elements 18 of each shoe base option 12*a*-12*d* to releasably secure each footbed option 16*a*-16*d* to a different shoe base option 12*a*-12*d*. In this way, the interchangeable footbed options 16*a*, 24*a*-16*d*, 24*d* of the exemplary modular shoe system 10 can be quickly and easily interchanged (e.g., removed, inserted, and/or replaced) to selectively adapt a single, modular shoe system 10 to any one of a plurality of different activities and/or conditions, while at the same time providing suitable and desired performance features for the respective activities and/or conditions, thereby enabling a user to wear a preferred or favorite pair of shoes in a variety of different use cases. Additionally or alternatively, the interchangeable footbed options 16*a*, 24*a*-16*d*, 24*d* of the exemplary modular shoe system 10 can be quickly and easily interchanged (e.g., removed, inserted, and/or replaced) to selectively adapt a single, modular shoe system 10 to one or more different aesthetic appearances or sensory characteristics, such as one or more materials, textures, colors, patterns, styles, etc. to enable a user to create their own custom and/or personalized look and/or feel.

Figure 7:
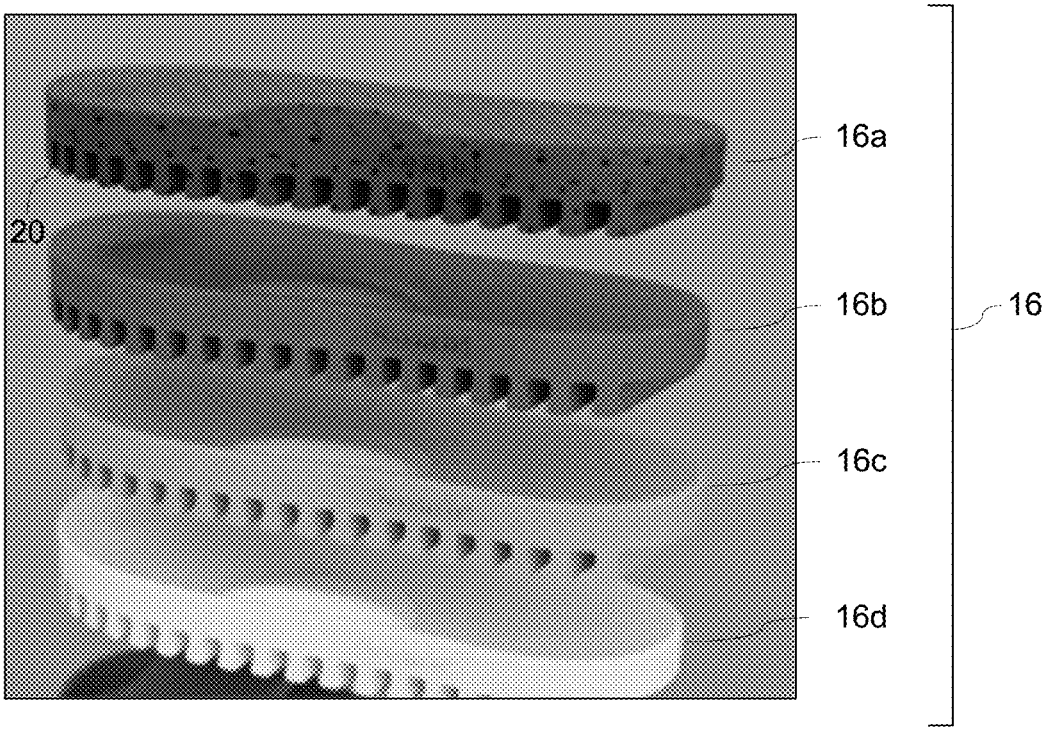
FIG. 7 is a partially exploded view of a modular shoe system, according to one or more embodiments of the present disclosure.
Figure 8:
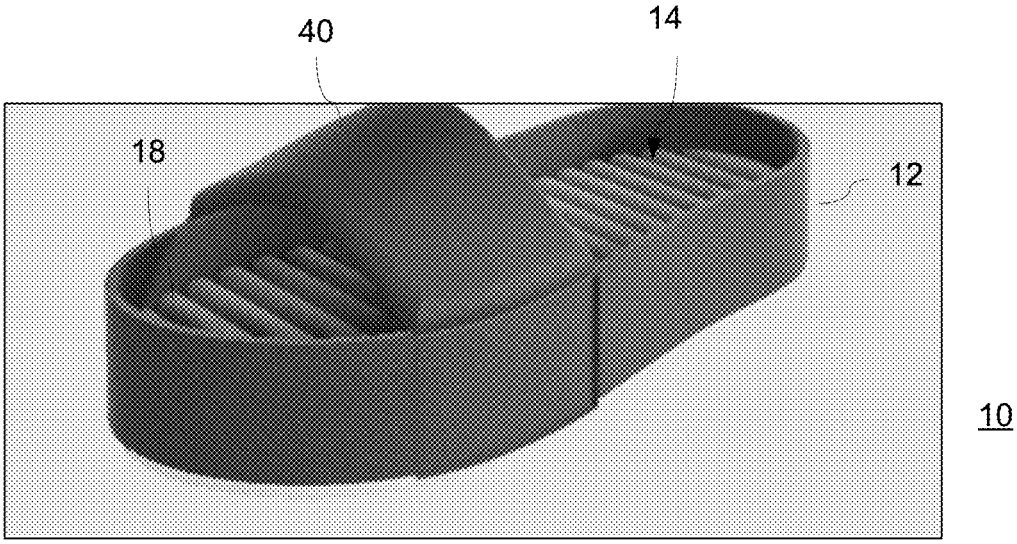
FIG. 8 is a perspective view of a shoe base of the modular shoe system of FIG. 7.

As shown in FIGS. 7 and 8, an exemplary modular shoe system 10 can include a plurality of interchangeable footbed options, which are represented by 16*a*-16*d*. The plurality of interchangeable footbed options can include one or more pairs of footbeds 16*a*-16*d* for use for specified activities such as running, hiking, walking, climbing, aerobic, cross-training, dance, fitness, athletics, etc. The plurality of interchangeable footbed options 16*a*-16*d* can include one or more orthotic footbed options, such as footbeds to provide arch support, support and/or relief for bunions, etc. The plurality of interchangeable footbed options 16*a*-16*d* can include one or more seasonal or weather-specific footbed inserts, such as footbeds that are waterproof, shearling-lined, sweat resistant, etc. The plurality of interchangeable footbed options 16*a*-16*d* can include one or more footbed inserts that aid in reducing or limiting formation of odor, smell, mold, fungus, etc., that provide support or relief at pressure points, etc., and/or that mold to a part of or all of a user's foot, such as memory foam inserts that mold to a heel or all of the user's foot. Other interchangeable footbed options are possible and would be readily envisaged by those skilled in the art.

As shown in FIGS. 7 and 8, in an example, the midsole 14 can include a plurality of first interlocking elements 18 and the footbed 16 can include a plurality of second interlocking elements 20. In this example, the plurality of first interlocking elements 18 and the plurality of second interlocking elements 20 are configured to interlock to releasably secure the footbed 16 to the midsole 14 of the shoe base 12. Each of the plurality of first interlocking elements 18 and the plurality of second interlocking elements 20 can be formed from a resilient material. For example, the interlocking elements can be formed using various suitable resilient materials, such as thermo-plastics (e.g., PVC), two-component polyurethanes (e.g., PU), co-polymers, rubbers, ethyl-vinyl acetates (e.g., EVA), and/or bio-derived or bio-inspired materials that are environmentally friendly, and equivalents thereof.

Figure 9:
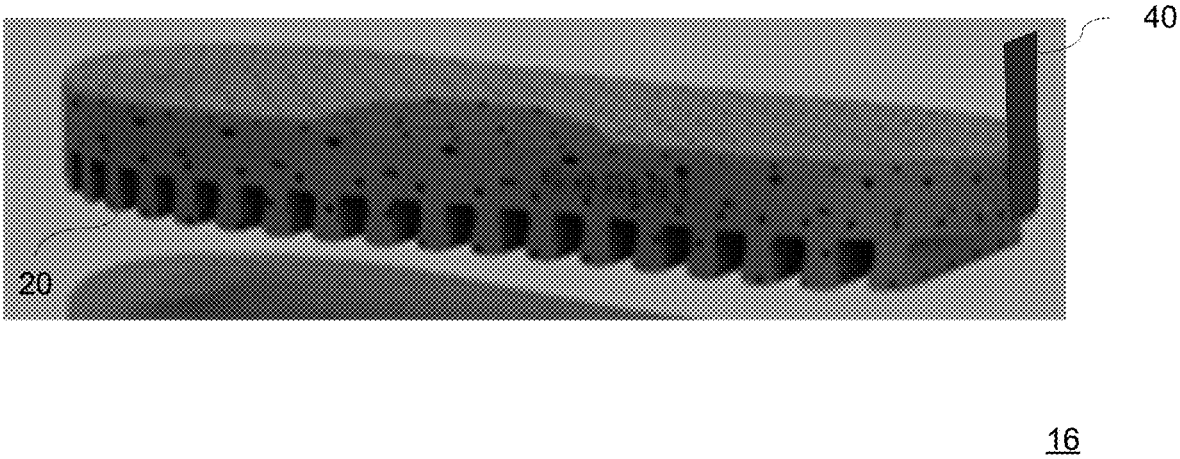
FIG. 9 is a perspective view of a footbed, according to one or more embodiments of the present disclosure.
Figure 10A:
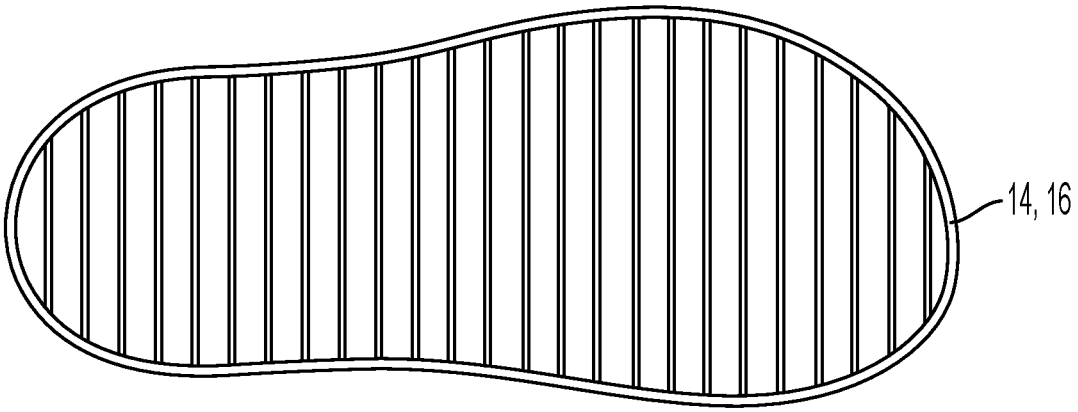
FIG. 10A is a plan view of assembled components of a modular shoe system, according to one or more embodiments of the present disclosure.
Figure 10B:
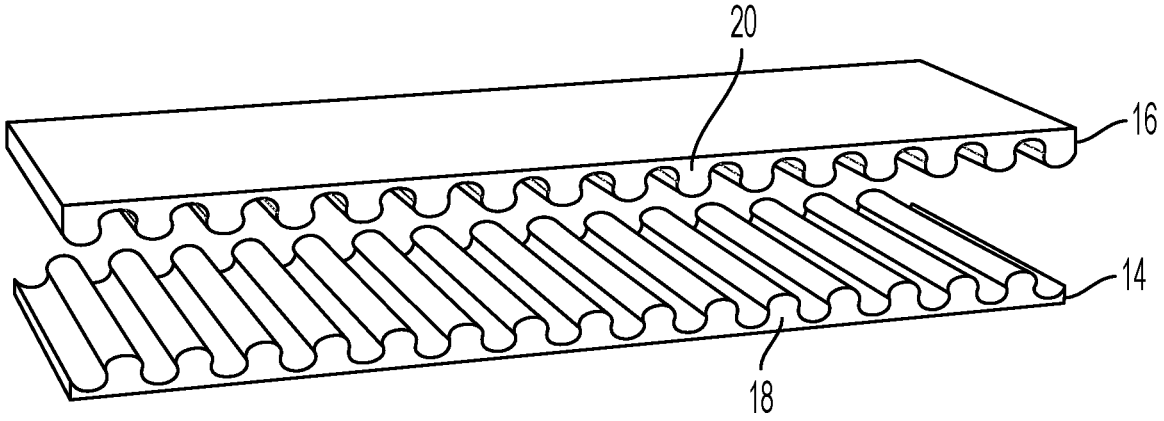
FIG. 10B is an exploded perspective view of the components of the modular shoe system of FIG. 10A.
Figure 10C:
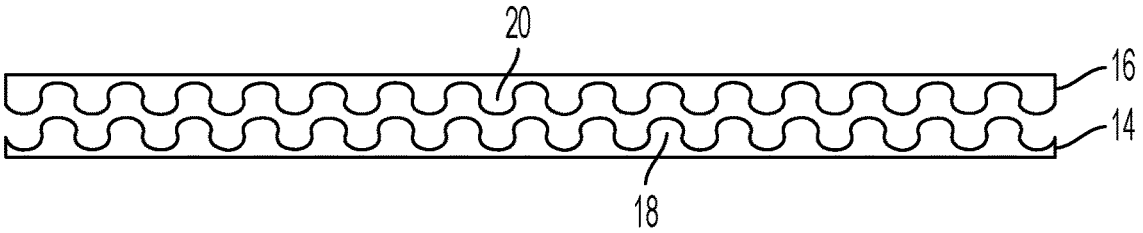
FIG. 10C is an exploded cross-sectional view of the components of the modular shoe system of FIG. 10A.
Figure 10D:
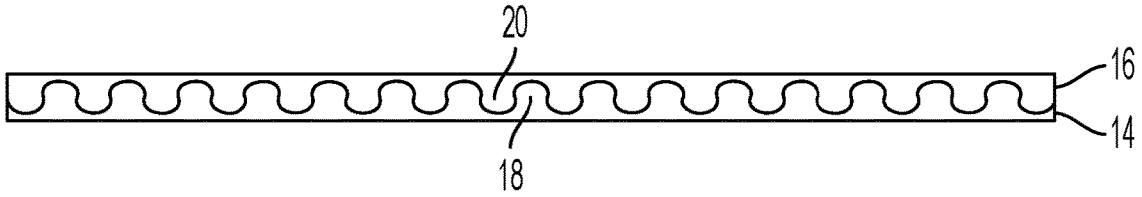
FIG. 10D is an assembled cross-sectional view of the components of the modular shoe system of FIG. 10A.
Figure 10E:
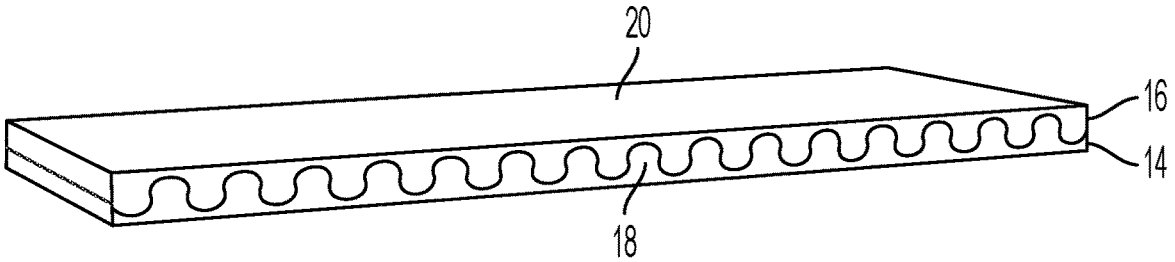
FIG. 10E is an assembled perspective view of the components of the modular shoe system of FIG. 10A.
Figure 11:
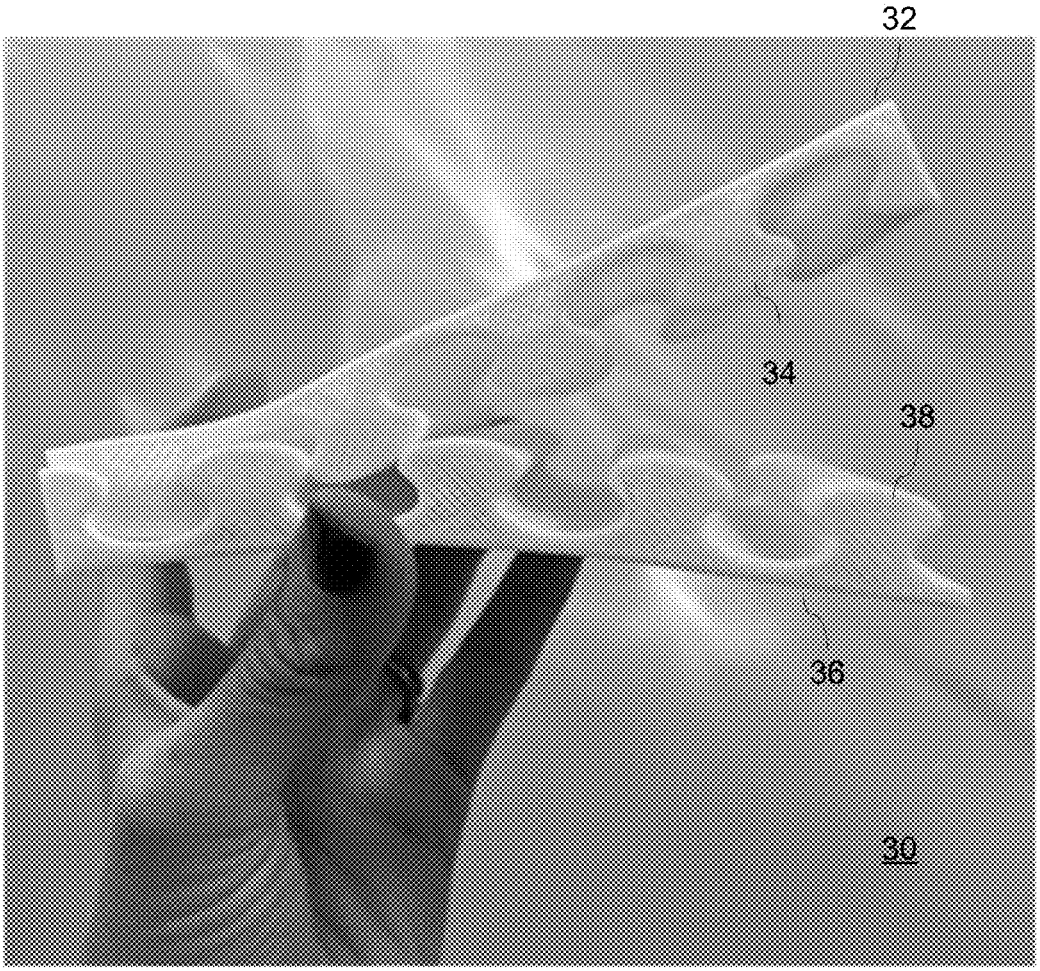
FIG. 11 is a perspective view of an interlocking fastener system, according to one or more embodiments of the present disclosure.
Figure 12:
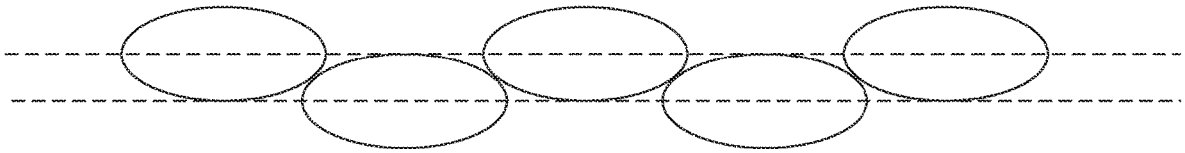
FIGS. 12 and 13 illustrate correlations of elements of wave patterns of an interlocking fastener system, according to one or more embodiments of the present disclosure.
Figure 13:
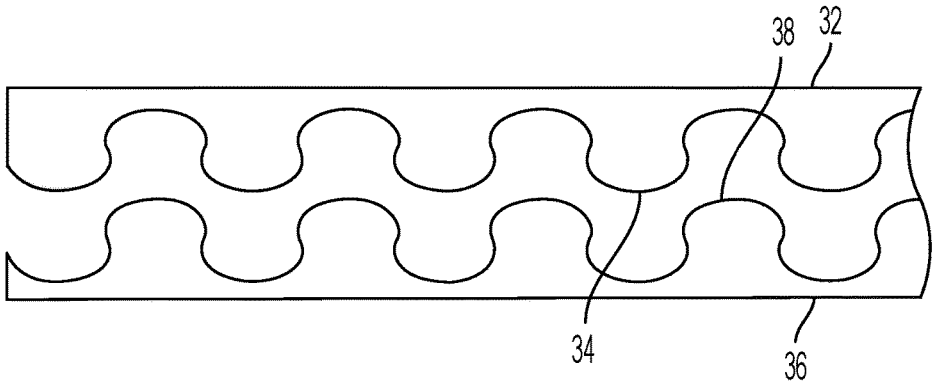

In an example, a footbed can include one or more tabs (e.g., one or more small tabs, finger tabs, etc.), such as a tab 40 located on or just behind the heel of the footbed 16, as shown in FIG. 9. By pulling the tab 40 located just behind the heel of the footbed 16, the footbed 16 can be detached from the midsole 14 of the shoe base 12 allowing for the user to remove the present footbed 16 and switch to a different desired footbed 16.

With reference to FIGS. 10A-14, examples of an interlocking fastener system 30 of an exemplary modular shoe system 10 will now be described.

With reference to FIGS. 10A-10E, examples of an interlocking fastener system 30 of an exemplary modular shoe system 10 can include a footbed 16 having a plurality of first interlocking elements 20, and a shoe base 12 having a plurality of second interlocking elements 18. The plurality of first interlocking elements 20 and the plurality of second interlocking elements 18 are configured to interlock to releasably secure the footbed 16 to the shoe base 12. Each of the plurality of first interlocking elements 20 and the plurality of second interlocking elements 18 can be formed from a resilient material, as described herein. In the example, the plurality of first interlocking elements 20 includes rows of concentric ovals interconnected into a wave pattern, and the plurality of second interlocking elements 18 includes rows of concentric ovals interconnected into a complementary wave pattern to the wave pattern of the plurality of first interlocking elements 20 such that the concentric ovals of the plurality of first interlocking elements 20 meet at a tangent with the concentric ovals of the plurality of second interlocking elements 18 when the plurality of first interlocking elements 20 interlock with the plurality of second interlocking elements 18. As shown in FIGS. 10A-10E, the wave patterns can have a length extending across a width of each of the footbed 16 and shoe base 12. In the example, the cross-section of the wave patterns is uniform or constant along the length of the wave pattern (e.g., along the entire length of the waves and troughs).

With reference to FIGS. 11-14, in illustrated examples, the interlocking fastener system 30 can include a first support layer 32 having a plurality of first interlocking elements 34, and a second support layer 36 having a plurality of second interlocking elements 38. The first support layer 32 can be integrally formed with or coupled to one of the footbed 16 or the shoe base 12 (e.g., the midsole 14 of the shoe base 12) and the second support layer 36 can be integrally formed with or coupled to the other of the footbed 16 or the shoe base 12 (e.g., the midsole 14 of the shoe base 12). The plurality of first interlocking elements 34 and the plurality of second interlocking elements 38 are configured to interlock to releasably secure the first support layer 32 to the second support layer 36. Each of the plurality of first interlocking elements 34 and the plurality of second interlocking elements 38 can be formed from a resilient material, as described herein. In the example, the plurality of first interlocking elements 34 includes rows of concentric ovals interconnected into a wave pattern, and the plurality of second interlocking elements 38 includes rows of concentric ovals interconnected into a complementary wave pattern to the wave pattern of the plurality of first interlocking elements 34 such that the concentric ovals of the plurality of first interlocking elements 34 meet at a tangent with the concentric ovals of the plurality of second interlocking elements 38 when the plurality of first interlocking elements 34 interlock with the plurality of second interlocking elements 38, as shown on the left-hand side of FIG. 11. A cross-section of each of the plurality of first interlocking elements 34 can correspond or match, and more particularly, can be complementary to, a cross-section of each of the plurality of second interlocking elements 38.

With reference again to FIGS. 11-14, the cross-section of the plurality of first interlocking elements 34 can include a pattern of alternating waves and troughs. The cross-section of the plurality of second interlocking elements 38 can include a pattern of complementary alternating waves and troughs. In the illustrated examples, a cross-section of each wave of the first and second interlocking elements 34 and 38 can include a protuberance at a crest of the wave. A cross-section of each trough of the first and second interlocking elements 34 and 38 can be complementary to the cross-section of the protuberance at the crest of each wave.

Figure 14:
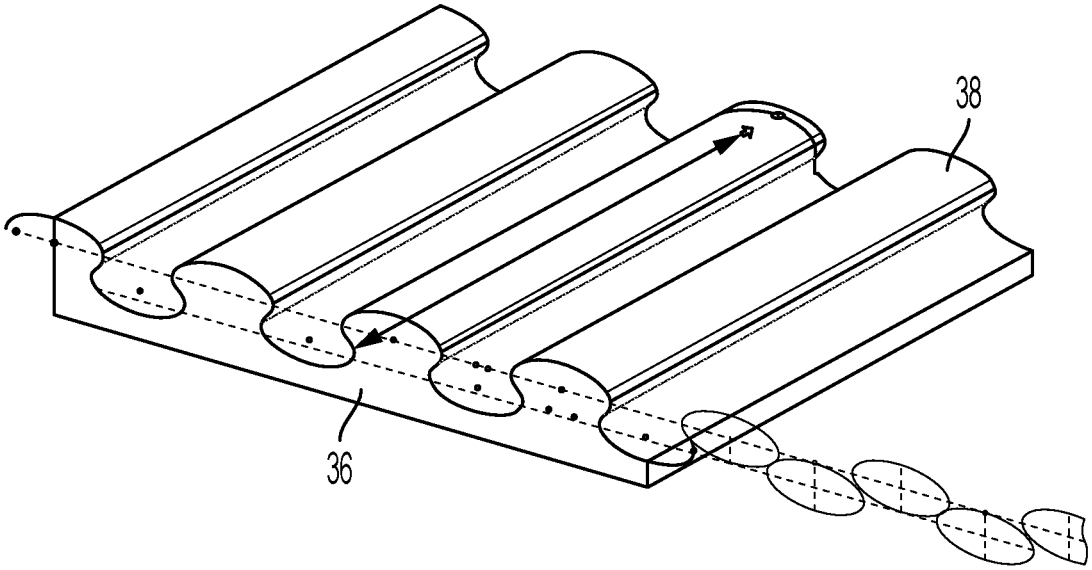
FIG. 14 is a perspective view of a component of an interlocking fastener system, according to one or more embodiments of the present disclosure.

As shown in FIG. 14, the wave patterns can have a length extending across a width of the support layer 36. The cross-section of the wave patterns can be uniform or constant along the length of the wave pattern (e.g., along the entire length of the waves and troughs). In other examples, the wave patterns can extend at a different angle, such as lengthwise with respect to the shoe base 12, at an angle other than lengthwise or widthwise with respect to the shoe base 12, etc.

With reference again to FIGS. 1-9, the plurality of first interlocking elements 18 of the midsole 14 of the shoe base 12 and the plurality of second interlocking elements 20 of each of the plurality of footbeds 16 can be formed by an interlocking fastener system, such as the interlocking fastener system 30 shown in FIGS. 11-14. In an example, the interlocking elements can be integrally formed with the midsole 14 of the shoe base 12 and/or integrally formed with the footbeds 16. In other examples, the midsole 14 of the shoe base 12 and/or the footbeds 16 can include a first support layer having the interlocking elements, with the support layer being coupled to the respective midsole 14 and/or footbed 16.

Figure 15:
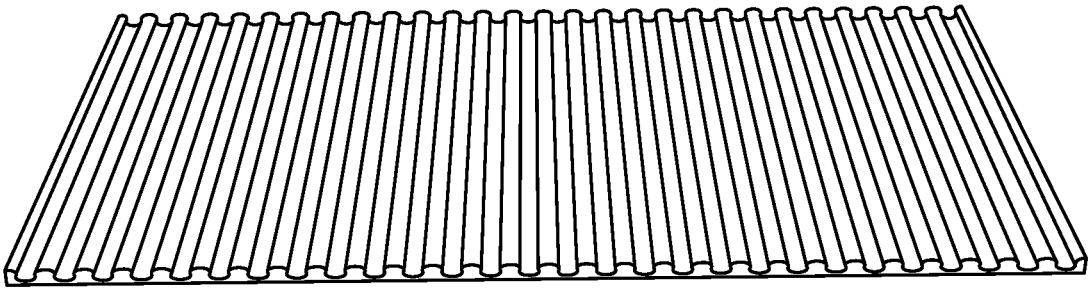
FIGS. 15-17 are perspective views illustrating steps of a method of forming components of an interlocking fastener system, according to one or more embodiments of the present disclosure.
Figure 16:
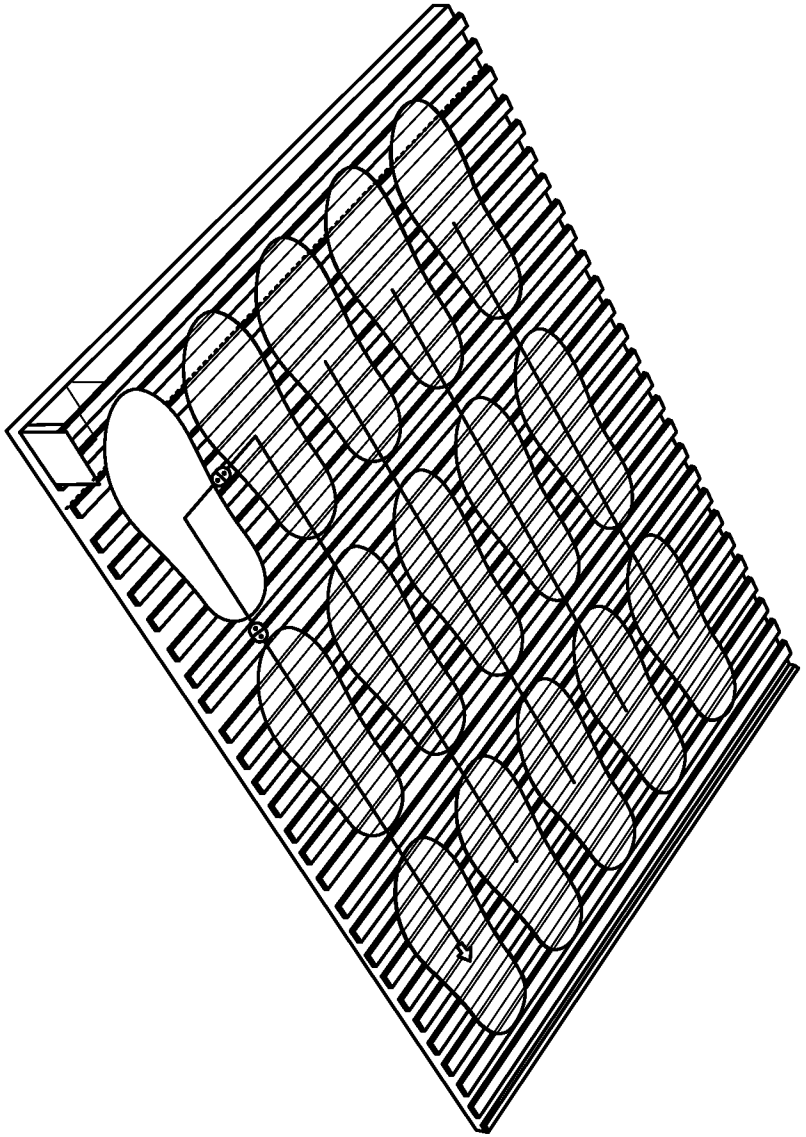
Figure 17:
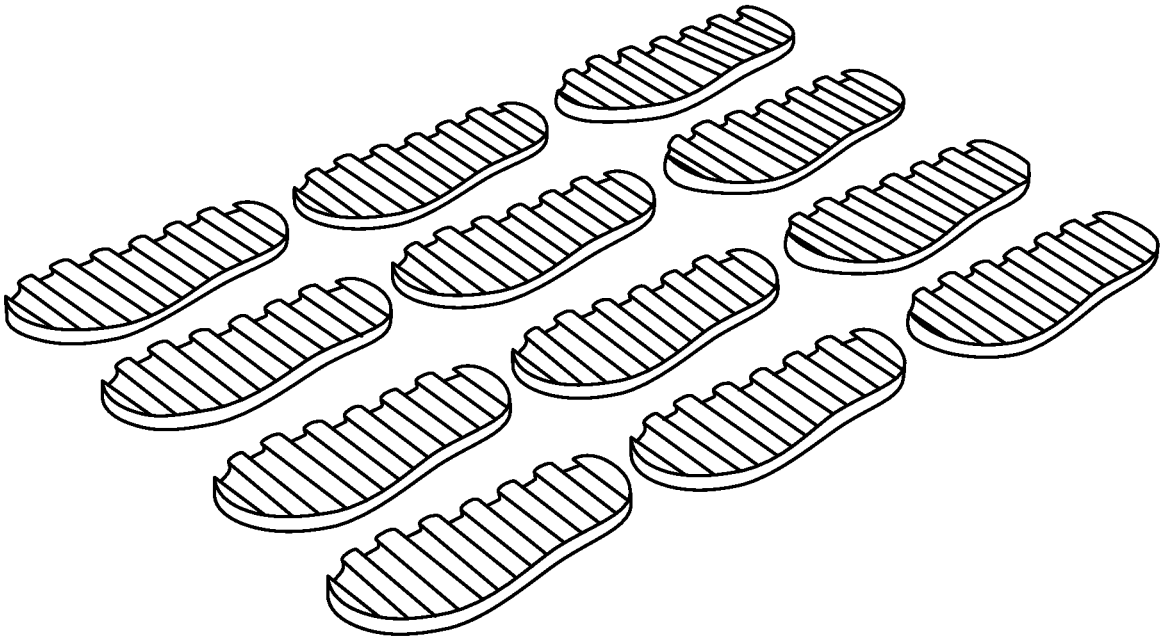

With reference to FIGS. 15-17, in an exemplary embodiment, the interlocking fastener system can be formed by producing sheets of material having the exemplary wave pattern. In an example of a modular shoe system 10 shown in FIGS. 1-8, the wave pattern sheets then can be cut to the desired size and shape, as shown in FIG. 9, and coupled into a top of a midsole 14 and/or to a bottom of a footbed 16, as shown in FIG. 1-8. The midsole 14 can be permanently coupled (e.g., glued) and installed into the shoe base 12, to provide "lower waves" on the top of the midsole 14 to accept the "upper waves" on the bottom of one of the plurality of footbeds 16. In an example, a variety of shoe base styles (e.g., sandal, mule, slides, different colors or fabrics, leathers, etc.) can be manufactured. Each of the styles of shoe base then can have the lower wave pattern sheets permanently installed as a connection piece. The various midsoles 14 of the shoe bases 12 will then be capable of accepting the "upper waves" on the bottom of one of the footbeds 16.

In another exemplary embodiment, a modular shoe system having the exemplary interlocking fastener system can be formed using injection molding or extrusion methods to form the waves directly into the midsole 14 and/or the footbeds 16. In this example, the midsole 14, comprising a plurality of first interlocking elements, can be formed as a unitary element with the shoe base 12 and are configured to receive a plurality of second interlocking elements from the footbed 16, which may also be formed as a unitary element.

With reference again to FIGS. 15-17, during manufacturing, the dimensions (e.g., size, spacing, shape, etc.) of the elements of the exemplary wave pattern can be selected and/or adjusted based on the particular application, use case, etc. The desired elements of the wave pattern then can be extruded along an axis extending in the direction of the length of the waves, as shown for example in FIG. 14.

In some embodiments, a midsole need not be produced by making sheets of material, but rather, individual midsole can be formed utilizing molds, 3D printing, extrusion processes and the like. In some embodiments, one or more midsole can be produced according to unique features of a user's foot such as foot size, shape, width, arch height, a user's weight, a user's gait style, etc. In such an embodiment, the user's information can be provided via analysis of the user's foot by photography, automated measuring tools, user inputted information, and the like.

With reference again to FIGS. 11-14, the examples of an interlocking fastener system 30 are not limited to application or incorporation into a footbed for a shoe or a shoe base of a modular shoe system. The examples of an interlocking fastener system 30 also can be utilized or incorporated into various other elements to facilitate releasably coupling one element to another and/or to provide interlocking interchangeability of a plurality elements on another element and/or to provide a stable and strong connection between elements and/or a united structure, while also enabling the elements to be easily released and/or reattached to each other.

While the examples illustrate the plurality of interlocking elements as including rows of concentric ovals interconnected into a wave pattern, one of ordinary skill in the art will recognize that other arrangements are possible within the spirit and scope of the disclosure. For example, the plurality of interlocking elements can include one or more rows of triangular-shaped protuberances, arrow-shaped protuberances, or protuberances having other shapes, such that complementary protuberances interlock with each other to releasably secure the footbed 16 to a part of the shoe base 12. In an example, the interlocking elements includes rows of protuberances interconnected into a pattern (e.g., a wave pattern) such that complementary protuberances interlock with each other.

In an example, one or more of a cross-sectional size, shape, pattern, spacing, etc. of the interlocking elements can be uniform along a length of the midsole of the shoe base 12 and/or footbed 16. In some examples, one or more interlocking elements include wave patterns having a length extending across a width of each of the footbed 16 and the midsole of the shoe base 12 (e.g., extending laterally across a width of each of the footbed 16 and the midsole of the shoe base 12). The cross-section of the wave patterns on each of the footbed 16 and the midsole of the shoe base 12 can be uniform or constant along the length of the wave pattern (e.g., along the entire length of the waves and troughs).

In another example, one or more of a size, shape, pattern, spacing, etc. of the interlocking elements can differ along a length of the midsole of the shoe base 12 and/or footbed 16. In some examples, the interlocking elements can be formed along a length of the midsole of the shoe base 12 and/or footbed 16 (e.g., along an entire length). In other examples, the interlocking elements can be formed only in particular areas of the midsole of the shoe base 12 and/or footbed 16, such as one or more interlocking elements, or groups of interlocking elements, being formed at different locations along a length of the midsole of the shoe base 12 and/or footbed 16 with spacing in between. In an example, one or more interlocking elements, or groups of interlocking elements, can be separated from another interlocking element, or group of interlocking elements, by a non-interlocking element or region, such as complimentary sinusoidal or square cross-sectional features, or a region that forms an air gap or a resilient feature, for example, to provide support, shock absorption, etc.

In an example, the interlocking elements can be configured such that the footbed 16 is capable of being attached to or aligned with the shoe base 12 in only a single way, such as a single position, arrangement, etc. For example, the interlocking elements can be configured such that a footbed 16 for a right shoe can only be coupled to a shoe base 12 of a right shoe and a footbed 16 for a left shoe can only be coupled to a shoe base 12 of a left shoe.

The interlocking elements, such as nub/wave features, connecting the footbed 16 to the midsole of the shoe base 12 locking elements can be configured to allow the footbed 16 to be removed and/or replaced (e.g., repeatedly removed and/or replaced) within the midsole of the shoe bed.

Moreover, while the examples illustrate a plurality of interlocking elements interconnected into a pattern (e.g., a wave pattern), one of ordinary skill in the art will recognize that other arrangements are possible within the spirit and scope of the disclosure. In other examples, the interlocking elements include one or more protuberances disposed at one or more predetermined locations along the footbed 16 such that one more complementary protuberances on a part of the shoe base 12 interlock with them to releasably secure the footbed 16 to a part of the shoe base 12. A location of one or more interlocking elements can be selected depending, for example, on a type, style, configuration, etc. of the shoe, a location prone to separation during use, a location subjected to greater force during use, a location outside of an upper of the shoe, among other things. In an example, the interlocking fastener system 30 includes a single interlocking element interconnected into a complimentary interlocking element such that the complementary interlocking elements interlock with each other to releasably secure the footbed 16 to a part of the shoe base 12. In an example, the interlocking fastener system 30 can include two or more interlocking elements, for example, spaced from one another, adjacent to one another, arranged in groups, arranged in patterns (e.g., a wave pattern), etc. and interconnected into complimentary interlocking elements such that the complementary interlocking elements interlock with each other to releasably secure the footbed 16 to a part of the shoe base 12.

While the examples illustrate an interlocking fastener system 30 including a plurality of interlocking elements having complimentary shapes, one of ordinary skill in the art will recognize that other arrangements are possible within the spirit and scope of the disclosure. In an example, one or more interlocking elements on either the footbed 16 and/or the shoe base 12 are configured to engage a part of the other of the footbed 16 and/or shoe base 12 to releasably secure the footbed 16 to a part of the shoe base 12. In an example, one or more interlocking elements on either the footbed 16 and/or the shoe base 12 has a different configuration and/or arrangement than the part of the other of the footbed 16 and/or shoe such as a different type, size, shape, etc. of interlocking element. In an example, one or more interlocking elements on either the footbed 16 and/or the shoe base 12 are configured to engage a part of the other of the footbed 16 and/or shoe such as a corresponding receptacle, notch, groove, protrusion, in the other of the footbed 16 and/or shoe base 12 to releasably secure the footbed 16 to a part of the shoe base 12.

Figure 18:
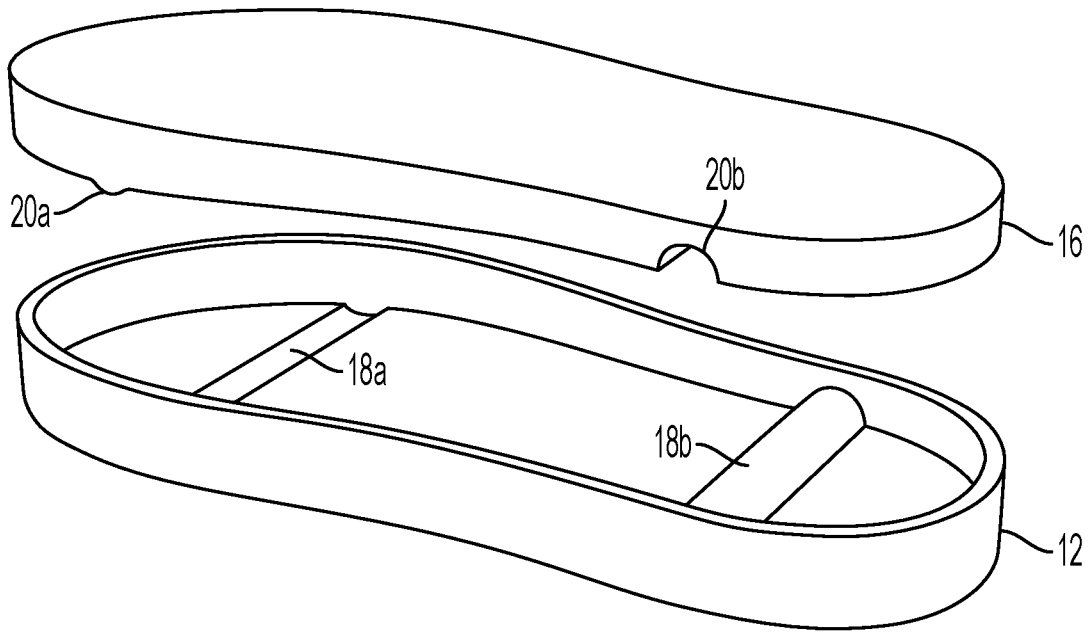
FIG. 18 is an exploded view of a shoe base and interchangeable footbed of a modular shoe system, according to one or more embodiments of the present disclosure.

For example, as shown in FIG. 18, an exemplary modular shoe system 10 includes a shoe base 12 having a pair of first interlocking elements 18*a*, 18*b* and the footbed 16 can include a corresponding pair of second interlocking elements 20*a*, 20*b*. In this example, the pair of first interlocking elements 18 and the pair of second interlocking elements 20 are configured to interlock to releasably secure an interchangeable footbed 16 to the shoe base 12. In this example, the first interlocking element 18*a* has a different configuration than the first interlocking element 18*b*, and the second interlocking element 20*a* has a different configuration than the second interlocking element 20*b*. The first interlocking element 18*a* is formed by a recess or groove extending across the shoe base 12, and the first interlocking element 18*b* is formed by a protuberance extending across the shoe base 12. The second interlocking element 20*a* is formed by a protuberance extending across the shoe base 12 and which compliments the first interlocking element 18*a*. The second interlocking element 20*b* is formed by a recess or groove extending across the shoe base 12 and which compliments the first interlocking element 18*b*. Each of the plurality of first interlocking elements 18 and the plurality of second interlocking elements 20 can be formed from a resilient material. In the example, the recesses or grooves and the protuberances have a partial cross-section of a cylinder.

Other configurations of one or more interlocking elements are possible and would be readily envisaged by those skilled in the art. For example, one or more interlocking elements can be formed by a recess or groove and/or a protuberances having a curved, square, rectangular, triangular, or other shaped cross-section. In an example, a cross-sectional shape of an interlocking element can be angled, hooked, tapered, etc., for example, in a direction extending from a front of the shoe base 12 toward a rear of the shoe base 12, or vice versa. In an example, a cross-sectional shape of two or more interlocking elements can be angled, hooked, tapered, etc., for example, in a direction extending from a front of the shoe base 12 toward a rear of the shoe base 12, or vice versa. In another example, a cross-sectional shape of two or more interlocking elements can be angled, hooked, tapered, etc., for example, in different directions, such as extending from a front of the shoe base 12 toward a rear of the shoe base 12, extending from a rear of the shoe base 12 toward a front of the shoe base 12. In yet another example, a cross-sectional shape of an interlocking element can be angled, hooked, tapered, etc., for example, in a direction extending across the shoe base 12 or at an angle with respect to a longitudinal length of the shoe base 12. In an example, one or more interlocking elements 18, 20 can extend entirely across a dimension (e.g., lateral width or longitudinal length) of the shoe base 12, a midsole 14 of the shoe base 12, and/or the footbed 16. In an example, one or more interlocking elements 18, 20 can extend partially across a dimension (e.g., lateral width or longitudinal length) of the shoe base 12, a midsole 14 of the shoe base 12, and/or the footbed 16.

The exemplary modular shoe system and components thereof can include one or more features or combinations of features illustrated in any of the examples shown in FIGS. 1-18.

With reference again to FIGS. 1-18, an example footbed for a modular shoe system includes a first surface configured to support a foot of a user, and a second surface configured to be inserted into the modular shoe system, wherein the second surface includes at least one first interlocking element configured to interlock with at least one second interlocking element on the modular shoe system.

With reference again to FIGS. 1-18, an example modular shoe system includes a shoe base, and a footbed, wherein the shoe base includes at least one first interlocking element and the footbed includes at least one second interlocking element, and wherein the at least one first interlocking element and the at least one second interlocking element are configured to interlock to releasably secure the footbed to a part of the shoe base.

With reference again to FIGS. 1-18, an example modular shoe system includes a shoe base, a footbed, and means for releasably securing the footbed to a part of the shoe base.

With reference again to FIGS. 1-18, an example interlocking fastener system for releasably coupling a plurality of first elements and second elements together includes a first support layer having a plurality of first interlocking elements, a second support layer having a plurality of second interlocking elements, wherein the plurality of first interlocking elements and the plurality of second interlocking elements are configured to interlock to releasably secure the first support layer to the second support layer, and wherein a cross-section of each of the plurality of first interlocking elements is complementary to a cross-section of each of the plurality of second interlocking elements. In an example, each of the plurality of first interlocking elements and the plurality of second interlocking elements are formed from a resilient material. In an example, the plurality of first interlocking elements includes rows of concentric ovals interconnected into a wave pattern, and wherein the plurality of second interlocking elements includes rows of concentric ovals interconnected into a complementary wave pattern to the wave pattern of the plurality of first interlocking elements such that the concentric ovals of the plurality of first interlocking elements meet at a tangent with the concentric ovals of the plurality of second interlocking elements when the plurality of first interlocking elements interlock with the plurality of second interlocking elements. In an example, the cross-section of the plurality of first interlocking elements includes a pattern of alternating waves and troughs, and the cross-section of the plurality of second interlocking elements includes a pattern of complementary alternating waves and troughs. In an example, a cross-section of each wave of the first and second interlocking elements includes a protuberance at a crest of the wave, and a cross-section of each trough of the first and second interlocking elements is complementary to the cross-section of the protuberance at the crest of each wave.

The present disclosure is not to be limited in terms of the particular embodiments described in this application, which are intended as illustrations of various aspects. Many modifications and variations can be made without departing from its spirit and scope. Functionally equivalent methods and apparatuses within the scope of the disclosure, in addition to those enumerated herein, are possible from the foregoing descriptions. Such modifications and variations are intended to fall within the scope of the appended claims. The present disclosure is to be limited only by the terms of the appended claims, along with the full scope of equivalents to which such claims are entitled. The terminology used herein is for the purpose of describing particular embodiments only and is not intended to be limiting.

What is claimed is:

1. A footbed for a modular shoe system, the footbed comprising:

a top surface; and a bottom surface;

wherein the bottom surface comprises a plurality of integrally-formed first interlocking elements configured to releasably secure the footbed to a plurality of second interlocking elements of the modular shoe system;

wherein the plurality of first interlocking elements comprise rows of concentric ovals interconnected into a first wave pattern;

wherein the plurality of second interlocking elements comprise rows of concentric ovals interconnected into a second wave pattern that is complementary to the first wave pattern; and wherein the concentric ovals of the plurality of first interlocking elements meet at a tangent with the concentric ovals of the plurality of second interlocking elements when the plurality of first interlocking elements and the plurality of second interlocking elements are interlocked.

2. The footbed of claim 1, wherein the plurality of first interlocking elements and the plurality of second interlocking elements each comprise a resilient material.

3. The footbed of claim 2, wherein the resilient material comprises polyvinylchloride, polyurethane, rubber, and/or ethylenevinyl acetate.

4. The footbed of claim 1, wherein a cross-section of the first wave pattern is uniform along an entire length of the first wave pattern and a cross-section of the second wave pattern is uniform along an entire length of the second wave pattern.

5. The footbed of claim 1, wherein the top surface is flat and the footbed comprises a foot support coupled to the top surface, wherein the foot support comprises a top side configured to support a foot of a user and a bottom side that is coupled to the top surface.

6. The footbed of claim 5, wherein the foot support is permanently coupled to the top surface.

7. The footbed of claim 1, wherein the top surface comprises an integrally-formed foot support configured to support a foot of a user.

8. A modular shoe system comprising:

a shoe base comprising a bottom surface and a top surface;

a midsole comprising a bottom surface and a top surface; and a footbed comprising a bottom surface and a top surface;

wherein the top surface of the shoe base is flat, wherein the bottom surface of the midsole is flat and coupled to the top surface of the shoe base;

wherein the top surface of the midsole comprises a plurality of integrally-formed first interlocking elements, the plurality of first interlocking elements comprising rows of concentric ovals interconnected into a first wave pattern;

wherein the bottom surface of the footbed comprises a plurality of integrally-formed second interlocking elements configured to releasably secure the footbed to the plurality of first interlocking elements of the midsole, the plurality of second interlocking elements comprising rows of concentric ovals interconnected into a second wave pattern that is complementary to the first wave pattern; and wherein the concentric ovals of the plurality of first interlocking elements meet at a tangent with the concentric ovals of the plurality of second interlocking elements when the plurality of first interlocking elements and the plurality of second interlocking elements are interlocked.

9. The modular shoe system of claim 8, wherein the bottom surface of the shoe base is flat and the modular shoe system comprises a sole coupled to the bottom surface of the shoe base.

10. The modular shoe system of claim 8, wherein the bottom surface of the shoe base comprises an integrally-formed sole.

11. The modular shoe system of claim 8, wherein the top surface of the footbed is flat and the modular shoe system comprises a foot support coupled to the top surface of the footbed, wherein the foot support comprises a top side configured to support a foot of a user and a bottom side that is coupled to the top surface of the footbed.

12. The modular shoe system of claim 11, wherein the foot support is permanently coupled to the top surface of the footbed.

13. The modular shoe system of claim 8, wherein the top surface of the footbed comprises an integrally-formed foot support configured to support a foot of a user.

14. The modular shoe system of claim 8, wherein the modular shoe system is a closed-back shoe.

15. The modular shoe system of claim 8, wherein the modular shoe system is an open-back shoe.

16. The modular shoe system of claim 8, wherein the modular shoe system comprises an upper coupled to the shoe base.

17. The modular shoe system of claim 8, wherein the shoe base further comprises an integrally-formed upper.

18. The modular shoe system of claim 8, wherein the plurality of first interlocking elements and the plurality of second interlocking elements each comprise a resilient material.

19. The modular shoe system of claim 18, wherein the resilient material comprises polyvinylchloride, polyurethane, rubber, and/or ethylenevinyl acetate.

20. The modular shoe system of claim 8, wherein a cross-section of the first wave pattern is uniform along an entire length of the first wave pattern and a cross-section of the second wave pattern is uniform along an entire length of the second wave pattern.

* * * * *